US012169094B2

(12) United States Patent
Kim et al.

(10) Patent No.: US 12,169,094 B2
(45) Date of Patent: Dec. 17, 2024

(54) VACUUM ADIABATIC MODULE, REFRIGERATOR, AND METHOD FOR FABRICATING THE REFRIGERATOR

(71) Applicant: LG ELECTRONICS INC., Seoul (KR)

(72) Inventors: Bongjin Kim, Seoul (KR); Deokhyun Youn, Seoul (KR); Jangseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/622,497

(22) PCT Filed: Jul. 8, 2020

(86) PCT No.: PCT/KR2020/008968
§ 371 (c)(1),
(2) Date: Dec. 23, 2021

(87) PCT Pub. No.: WO2021/020761
PCT Pub. Date: Feb. 4, 2021

(65) Prior Publication Data

US 2022/0252331 A1 Aug. 11, 2022

(30) Foreign Application Priority Data

Jul. 31, 2019 (KR) ..... 10-2019-0093375

(51) Int. Cl.
*F25D 23/06* (2006.01)
*F25D 23/08* (2006.01)

(52) U.S. Cl.
CPC ..... *F25D 23/062* (2013.01); *F25D 23/06* (2013.01); *F25D 23/065* (2013.01); *F25D 23/067* (2013.01); *F25D 2201/14* (2013.01)

(58) Field of Classification Search
CPC ..... F25D 23/062; F25D 23/06; F25D 23/067; F25D 2201/14; F25D 23/063; F25D 23/065; F25D 23/066; F16L 59/065
See application file for complete search history.

(56) References Cited

U.S. PATENT DOCUMENTS 2,000,882 A 5/1935 Comstock
2,867,035 A * 1/1959 Patterson, Jr. ..... F25D 23/06 428/920

(Continued)

FOREIGN PATENT DOCUMENTS

CN 201322500 Y 10/2009
CN 102401538 A 4/2012

(Continued)

OTHER PUBLICATIONS

Chinese Office Action dated Apr. 22, 2023 issued in Application 202080055748.5.

(Continued)

*Primary Examiner* — Kimberley S Wright
(74) *Attorney, Agent, or Firm* — KED & ASSOCIATES, LLP

(57) ABSTRACT

Provided is a vacuum adiabatic body. The vacuum adiabatic body includes a first plate configured to define at least a portion of a wall for a first space, a second plate configured to define at least a portion of a wall for a second space having a temperature different from that of the first space, a seal configured to seal the first plate and the second plate so as to provide a third space that has a temperature between a temperature of the first space and a temperature of the second space and is in a vacuum state, and a support configured to maintain the third space. Therefore, the vacuum adiabatic module that is thermally insulated with the (Continued)

vacuum, independently applied at various places, and conveniently used may be realized.

17 Claims, 21 Drawing Sheets

(56) References Cited

U.S. PATENT DOCUMENTS

| | | | | |
|---|---|---|---|---|
| 10,161,670 | B2 | 12/2018 | Jung et al. | |
| 10,788,257 | B2 | 9/2020 | Jung et al. | |
| 11,009,177 | B2 | 5/2021 | Jung et al. | |
| 11,047,616 | B2 | 6/2021 | Jeong et al. | |
| 2001/0033126 | A1* | 10/2001 | Nishimoto | B29C 44/1242 312/406 |
| 2004/0226956 | A1 | 11/2004 | Brooks | |
| 2007/0152551 | A1* | 7/2007 | Kim | F25D 23/063 312/401 |
| 2013/0257256 | A1 | 10/2013 | Allard et al. | |
| 2015/0030800 | A1 | 1/2015 | Jung et al. | |
| 2016/0109172 | A1* | 4/2016 | Kim | F25D 23/065 312/406.1 |
| 2018/0017314 | A1* | 1/2018 | Jeong | F25D 23/061 |
| 2018/0164022 | A1 | 6/2018 | Ding et al. | |
| 2018/0216872 | A1* | 8/2018 | Jung | F25D 23/028 |
| 2018/0224052 | A1* | 8/2018 | Jung | F25D 23/062 |
| 2018/0224193 | A1 | 8/2018 | Jung et al. | |
| 2018/0224194 | A1* | 8/2018 | Jung | F16L 59/065 |
| 2018/0238486 | A1* | 8/2018 | Jung | F25D 23/02 |
| 2018/0238610 | A1 | 8/2018 | Jung et al. | |
| 2018/0252464 | A1 | 9/2018 | Hirano et al. | |
| 2018/0266754 | A1* | 9/2018 | Hottmann | F25D 25/025 |
| 2019/0049169 | A1* | 2/2019 | Ciyanoglu | F25D 11/02 |
| 2020/0370819 | A1 | 11/2020 | Kim et al. | |

FOREIGN PATENT DOCUMENTS

| | | | |
|---|---|---|---|
| CN | 102455105 | A | 5/2012 |
| CN | 202470356 | U | 10/2012 |
| CN | 105352252 | | 2/2016 |
| CN | 107257907 | A | 10/2017 |
| CN | 107850380 | A | 3/2018 |
| CN | 207191914 | U | 4/2018 |
| CN | 108368962 | A | 8/2018 |
| CN | 108613462 | A | 10/2018 |
| CN | 110249193 | A | 9/2019 |
| EP | 2 719 981 | | 4/2014 |
| JP | 58186389 | | 12/1983 |
| JP | 2013-002654 | | 1/2013 |
| JP | 2015-158358 | | 9/2015 |
| JP | 2015-227774 | | 12/2015 |
| KR | 10-0343719 | | 7/2002 |
| KR | 10-2015-0012712 | | 2/2015 |
| KR | 10-2017-0016187 | | 2/2017 |
| KR | 10-2019-0070753 | | 6/2019 |
| RU | 2462669 | C2 | 9/2012 |
| RU | 2562207 | C2 | 9/2015 |
| RU | 2608791 | C1 | 1/2017 |
| WO | WO 2005/108883 | A1 | 11/2005 |
| WO | WO 2014/168391 | A1 | 10/2014 |

OTHER PUBLICATIONS

Extended European Search Report dated Jun. 28, 2023 issued in Application 20848318.0.

International Search Report and Written Opinion dated Oct. 16, 2020 issued in PCT Application No. PCT/KR2020/008968.

Russian Notice of Allowance dated Nov. 2, 2023 issued in Application 2022104764/10.

Chinese Office Action dated Mar. 5, 2024, issued in Application No. 202080055748.5.

Chinese Office Action dated Aug. 13, 2024 issued in Application 202080055748.5.

Korean Office Action dated Aug. 27, 2024 issued in Application 10-2019-0093375.

Chinese Notice of Allowance dated Oct. 21, 2024 issued in Application 202080055748.5.

* cited by examiner

[Fig. 1]
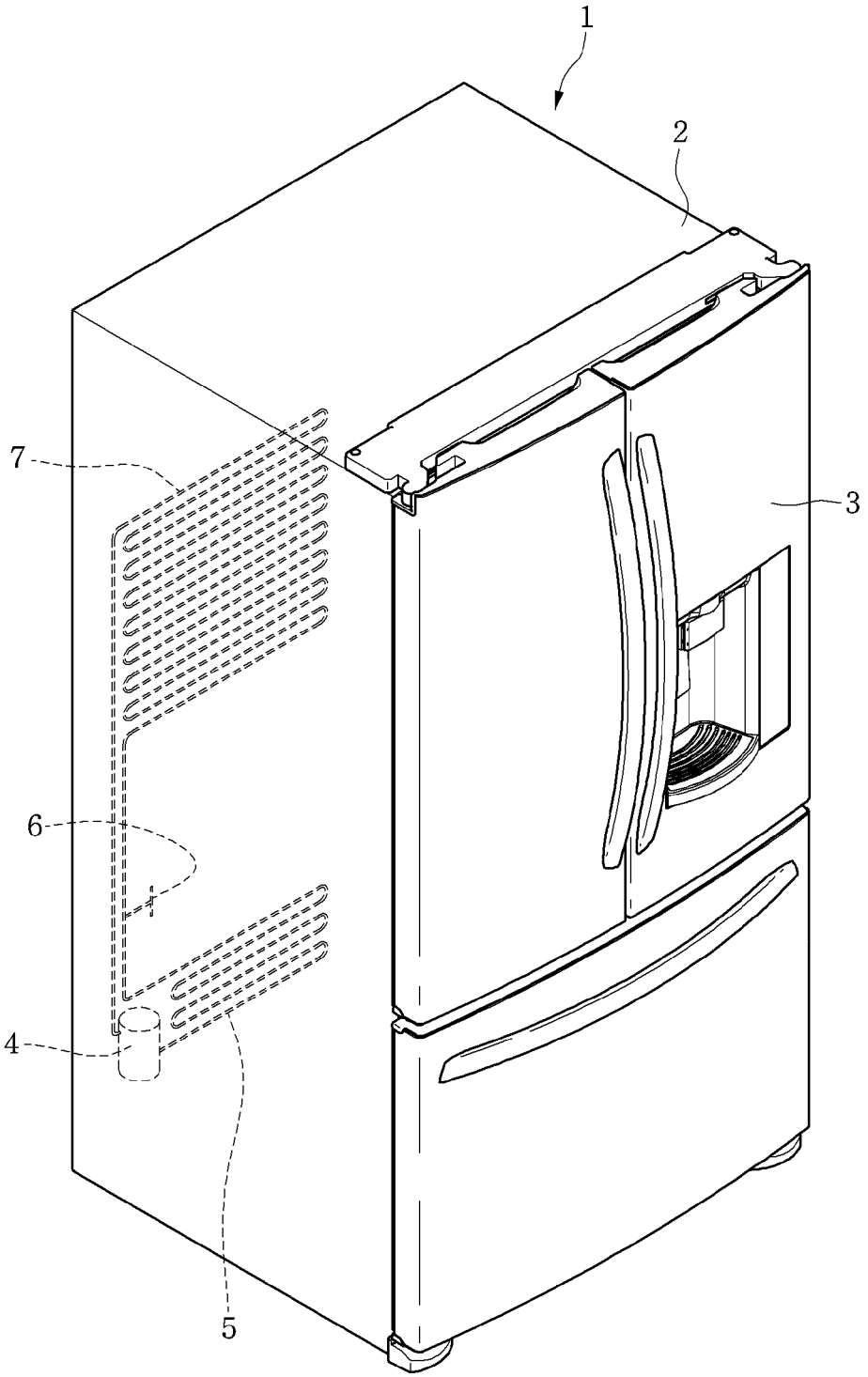

[Fig. 2]
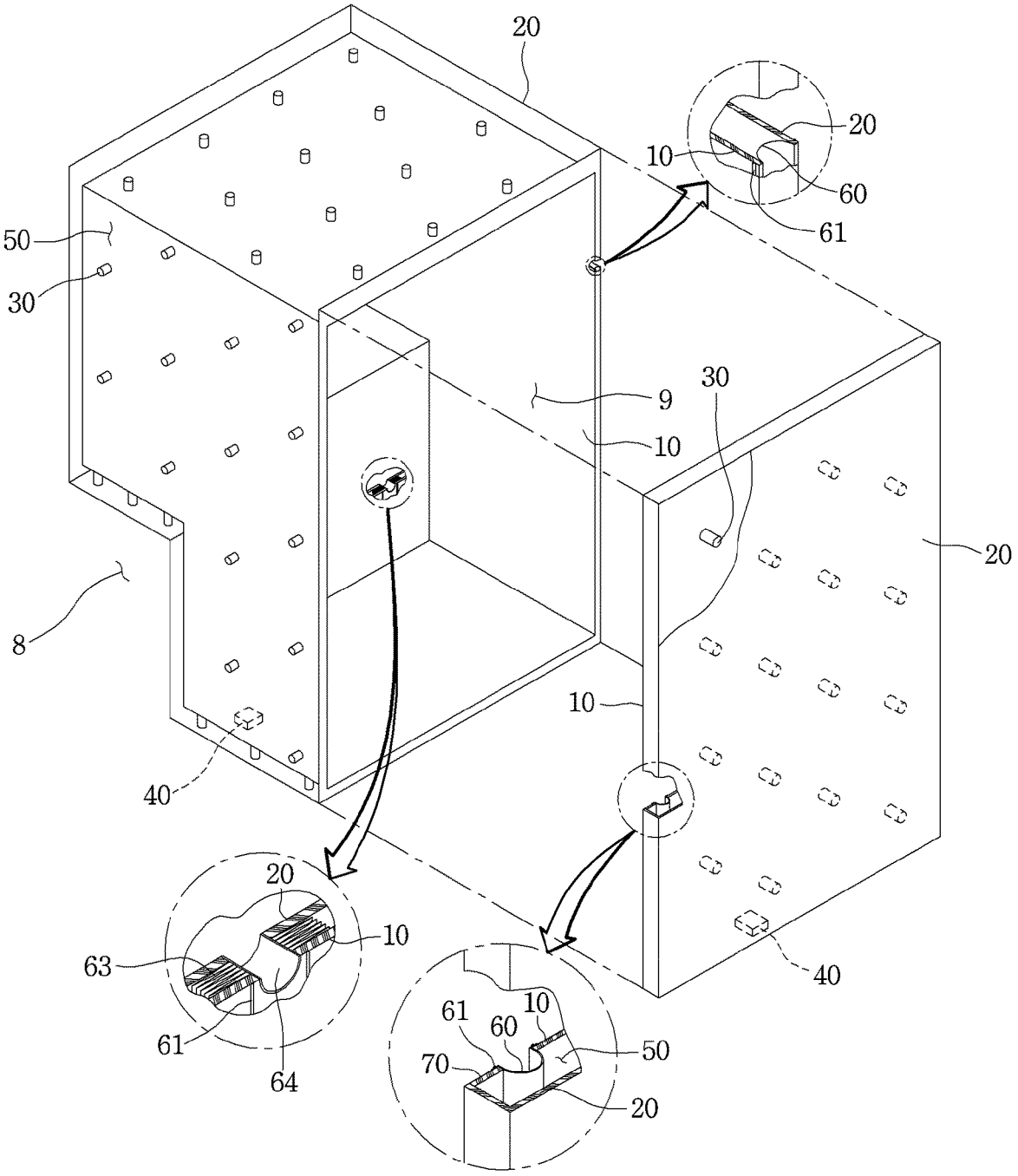

[Fig. 3]
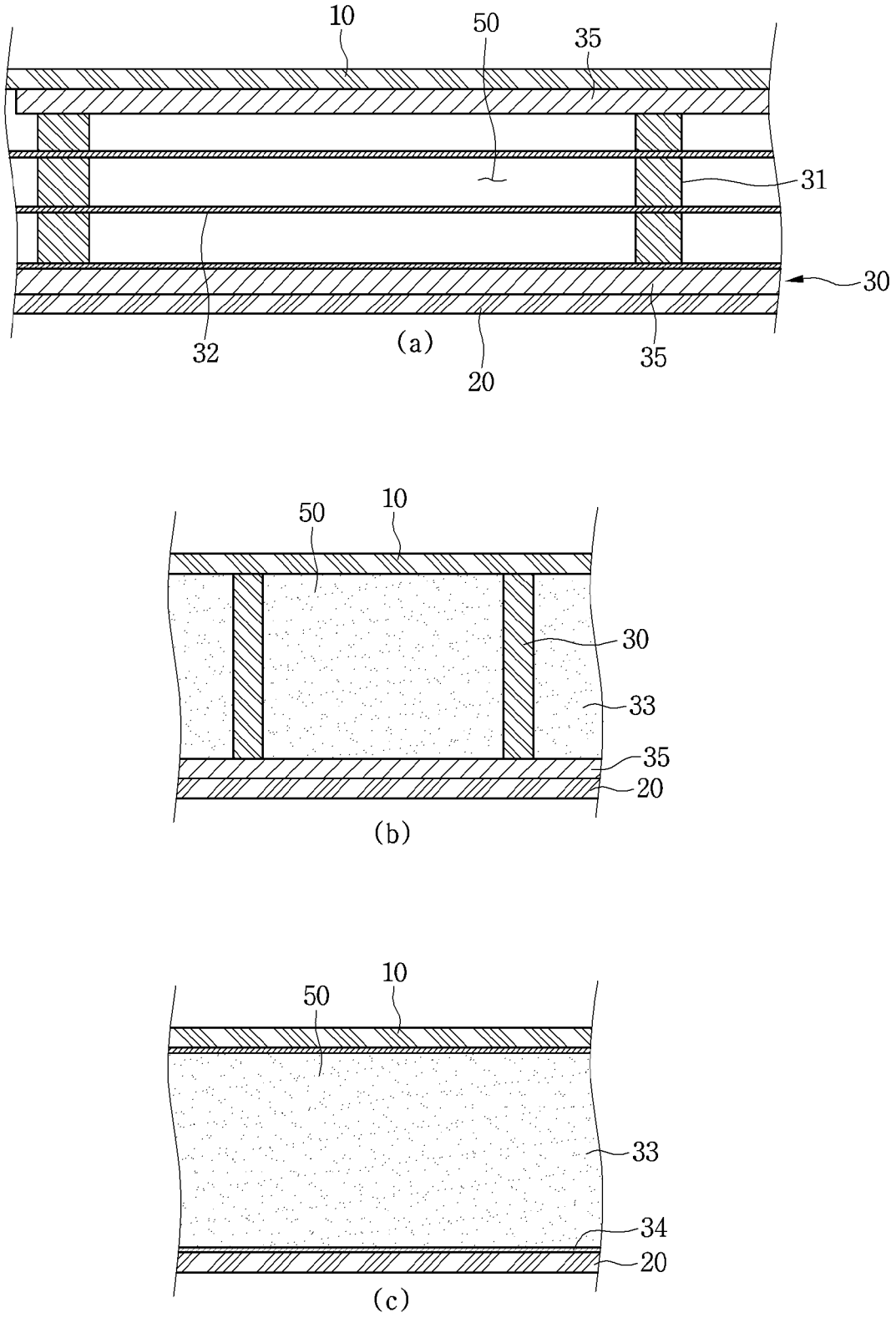

[Fig. 4]
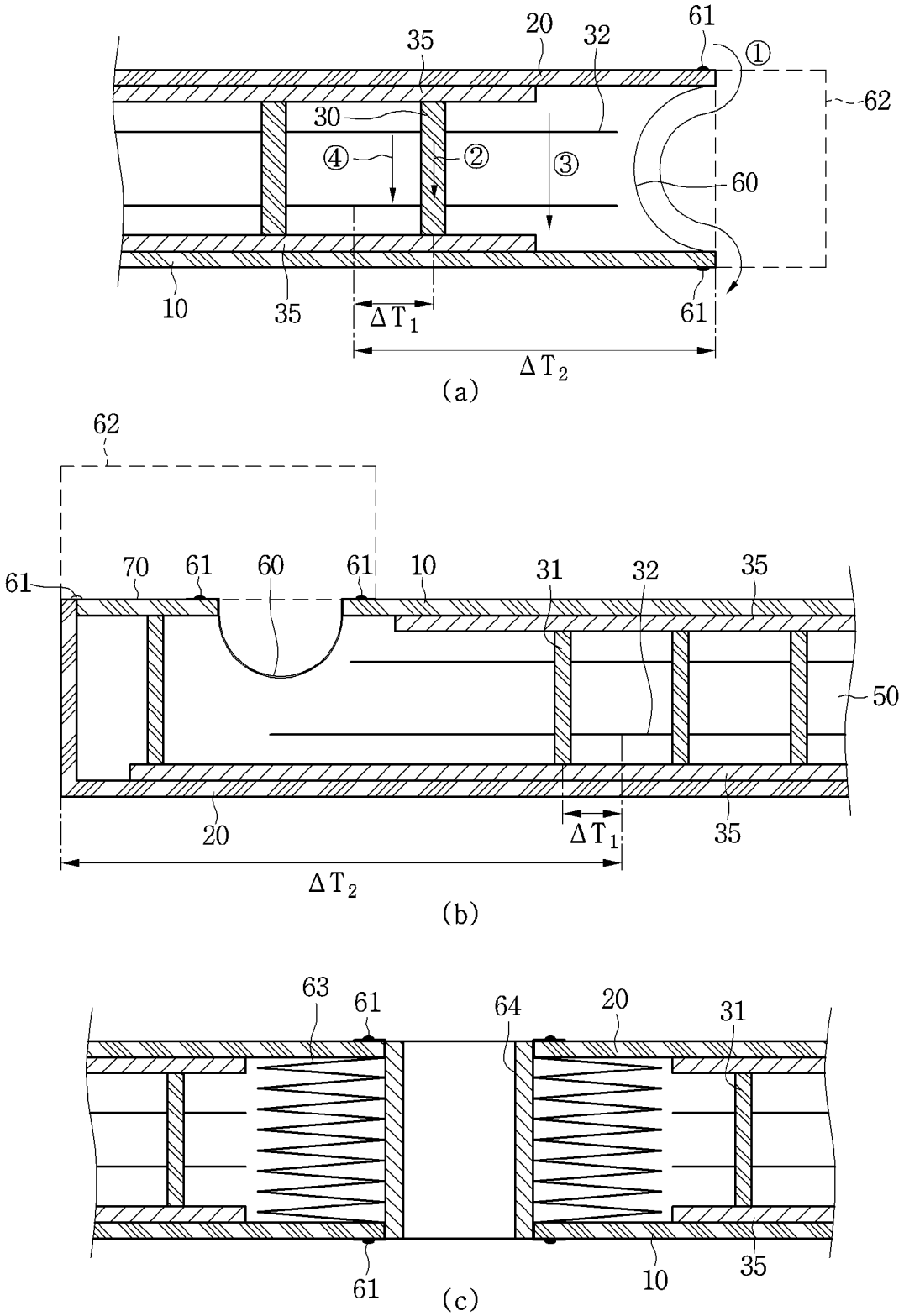

[Fig. 5]
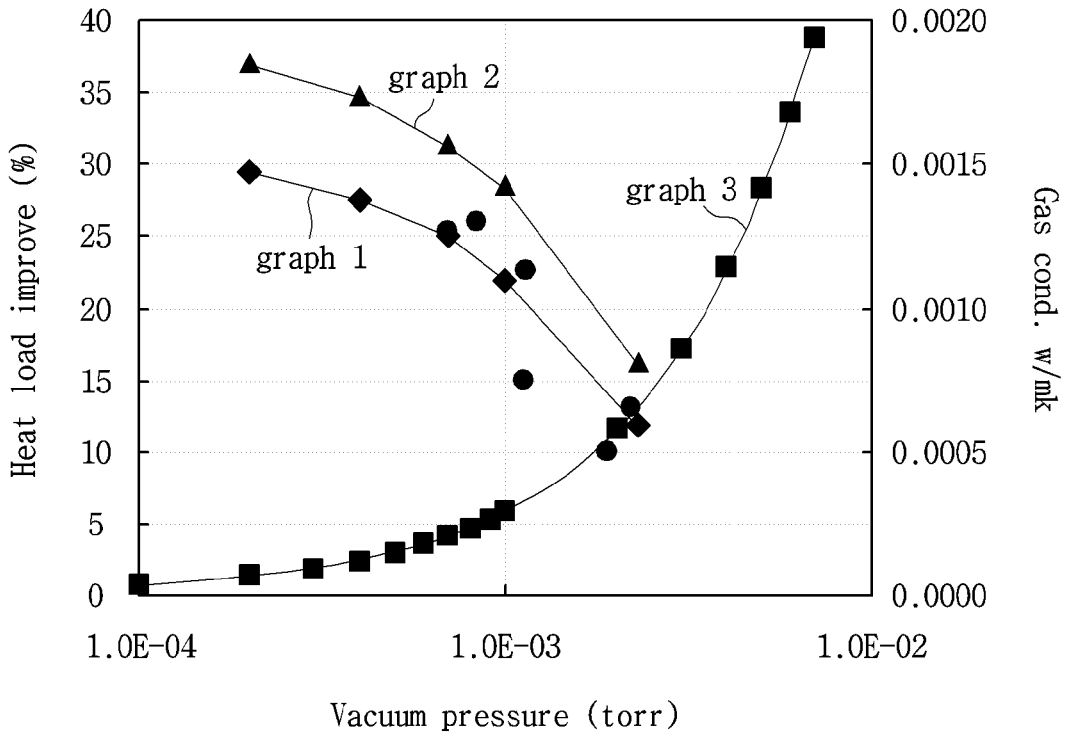
[Fig. 6]
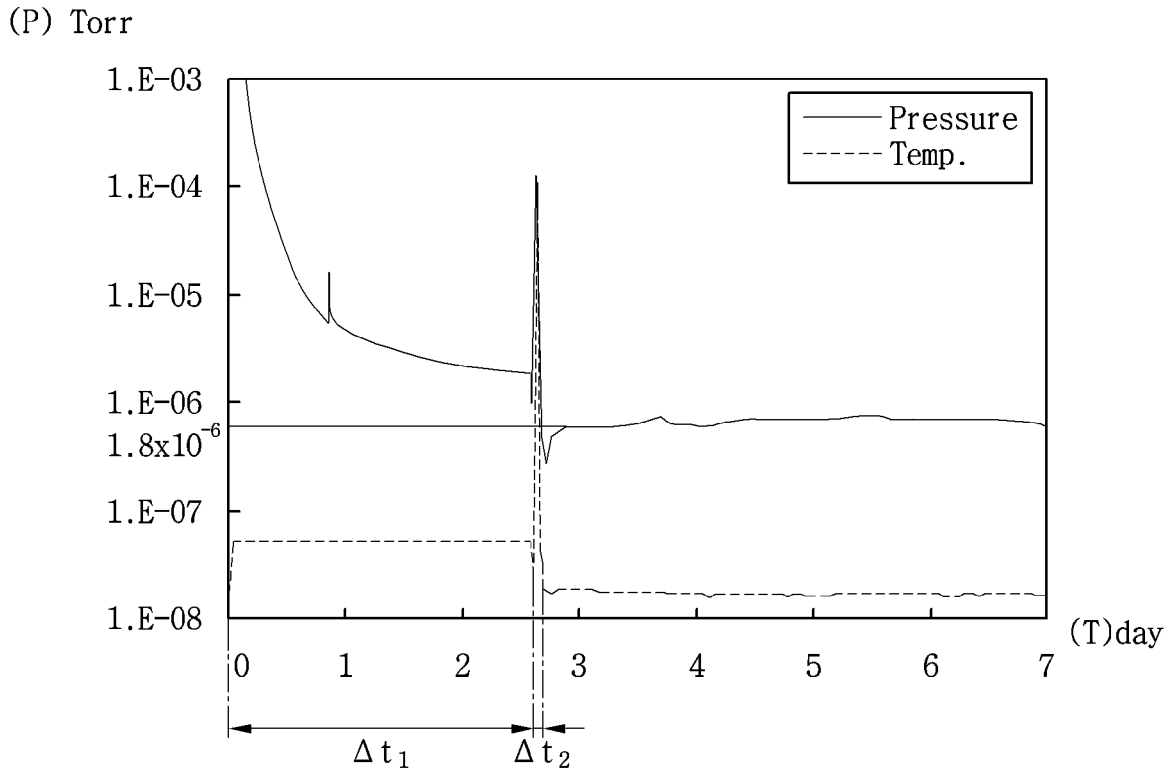

[Fig. 7]
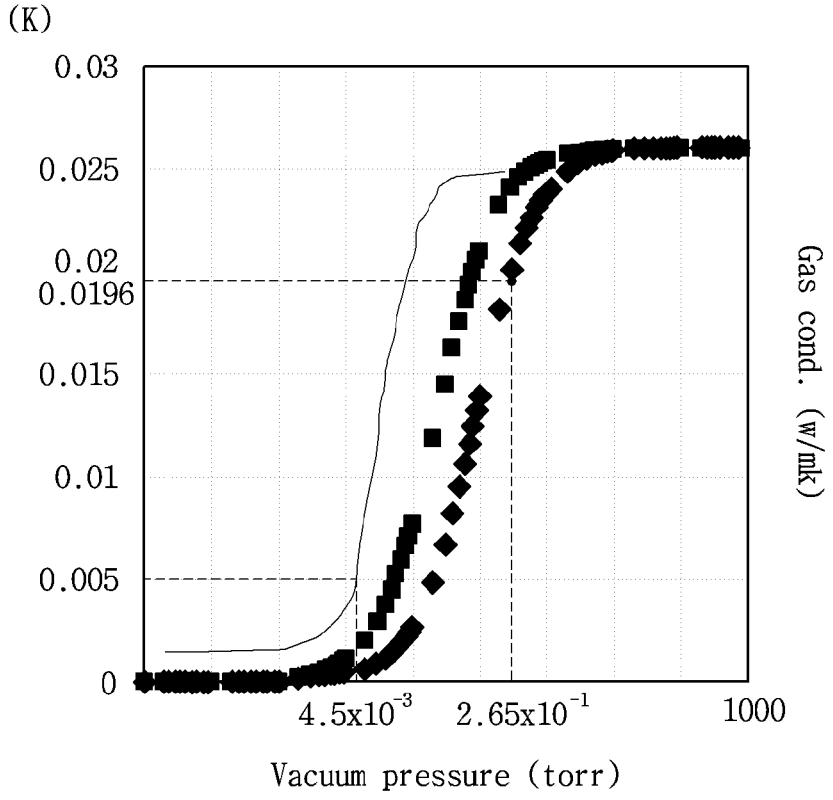

[Fig. 8]
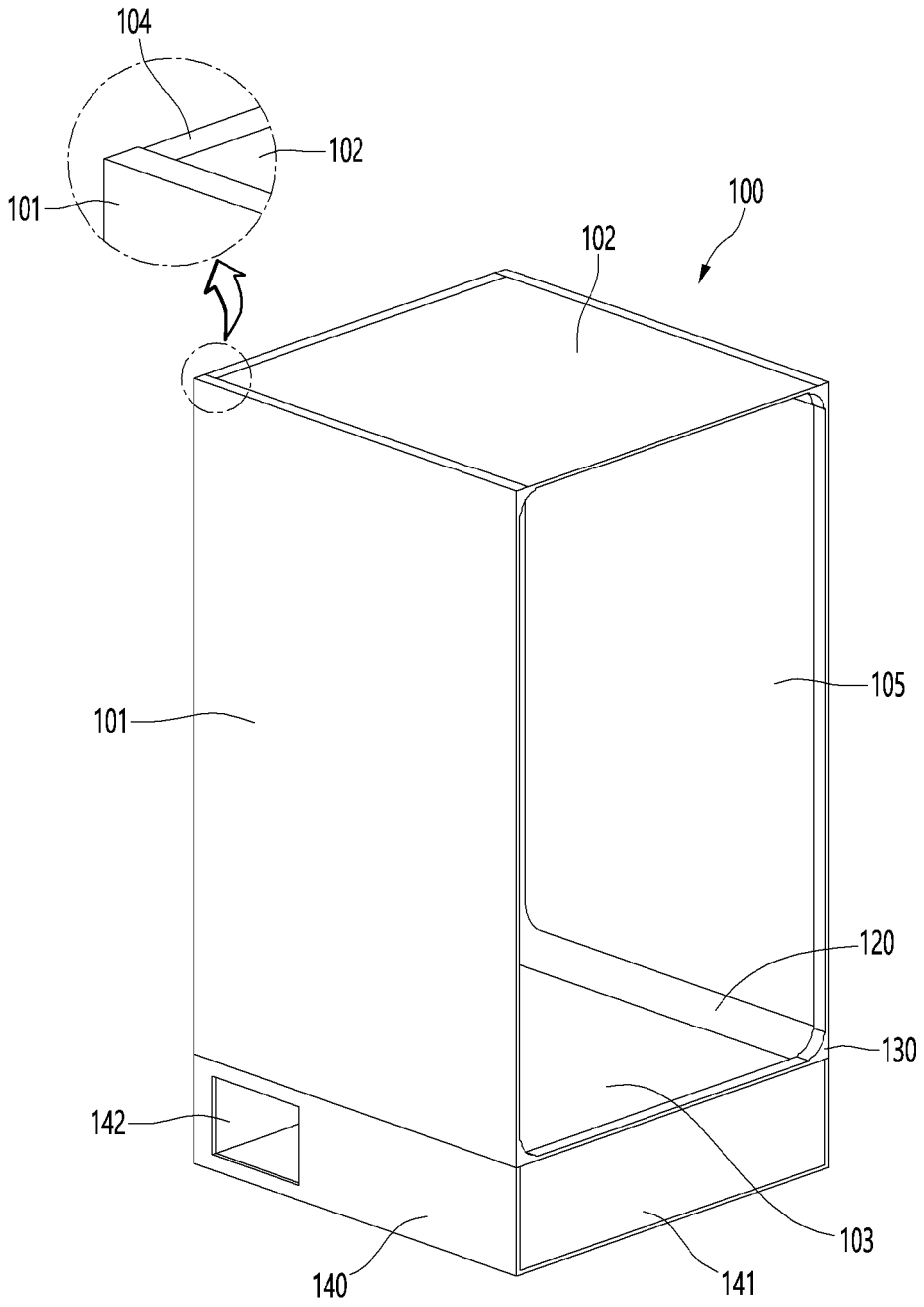

[Fig. 9]
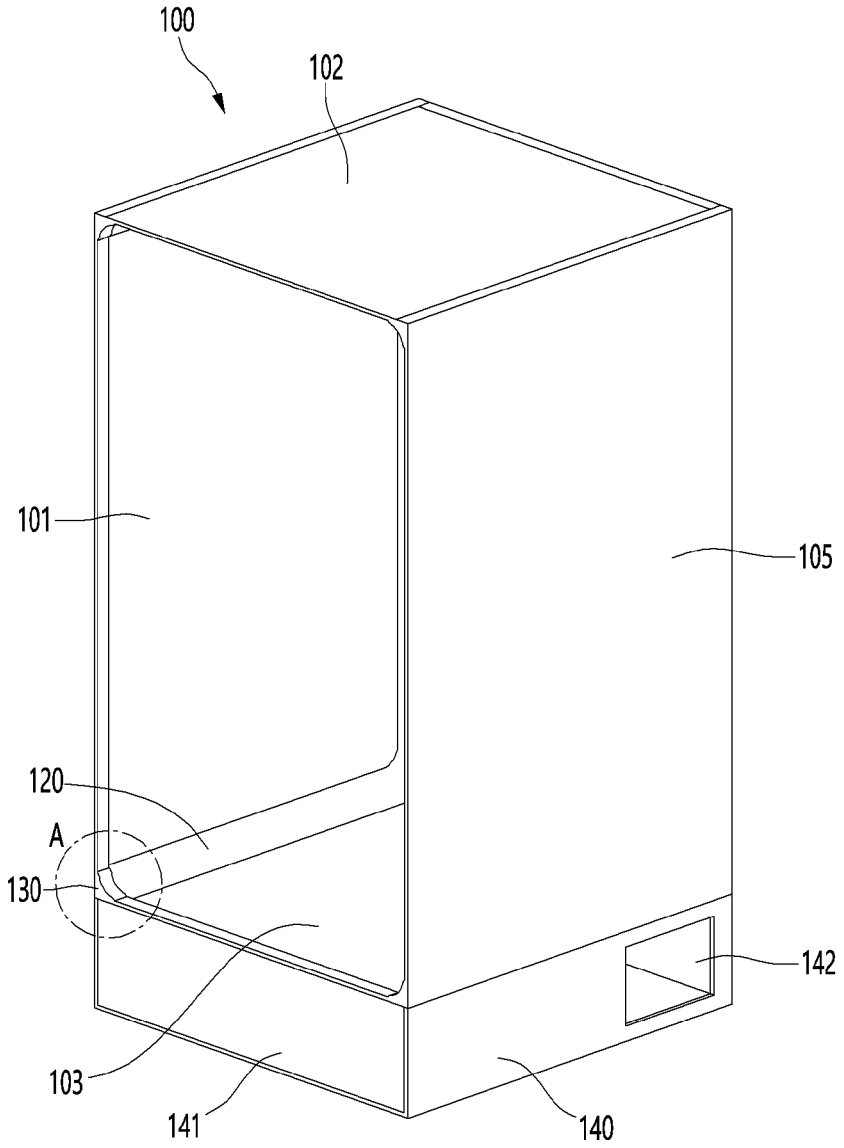

[Fig. 10]
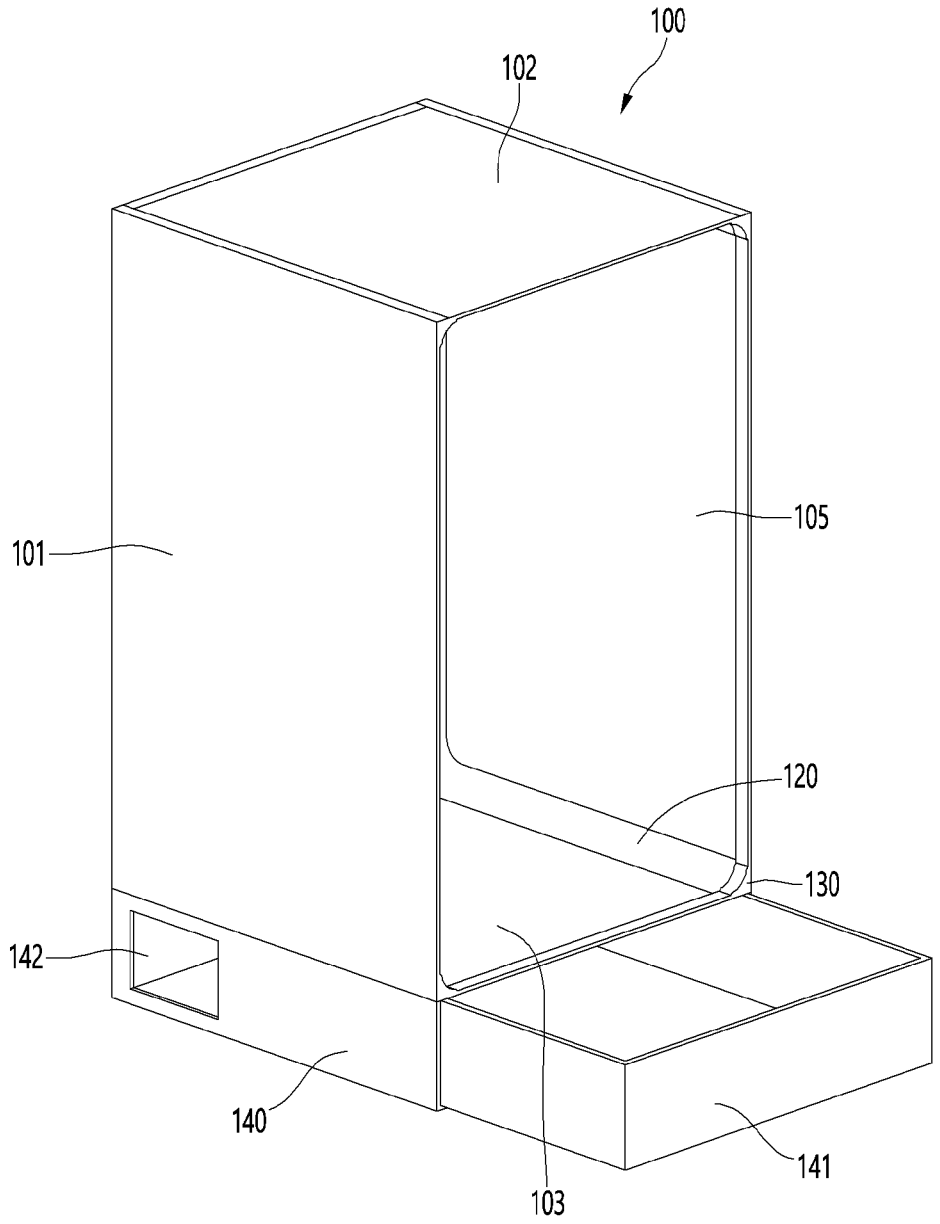

[Fig. 11]
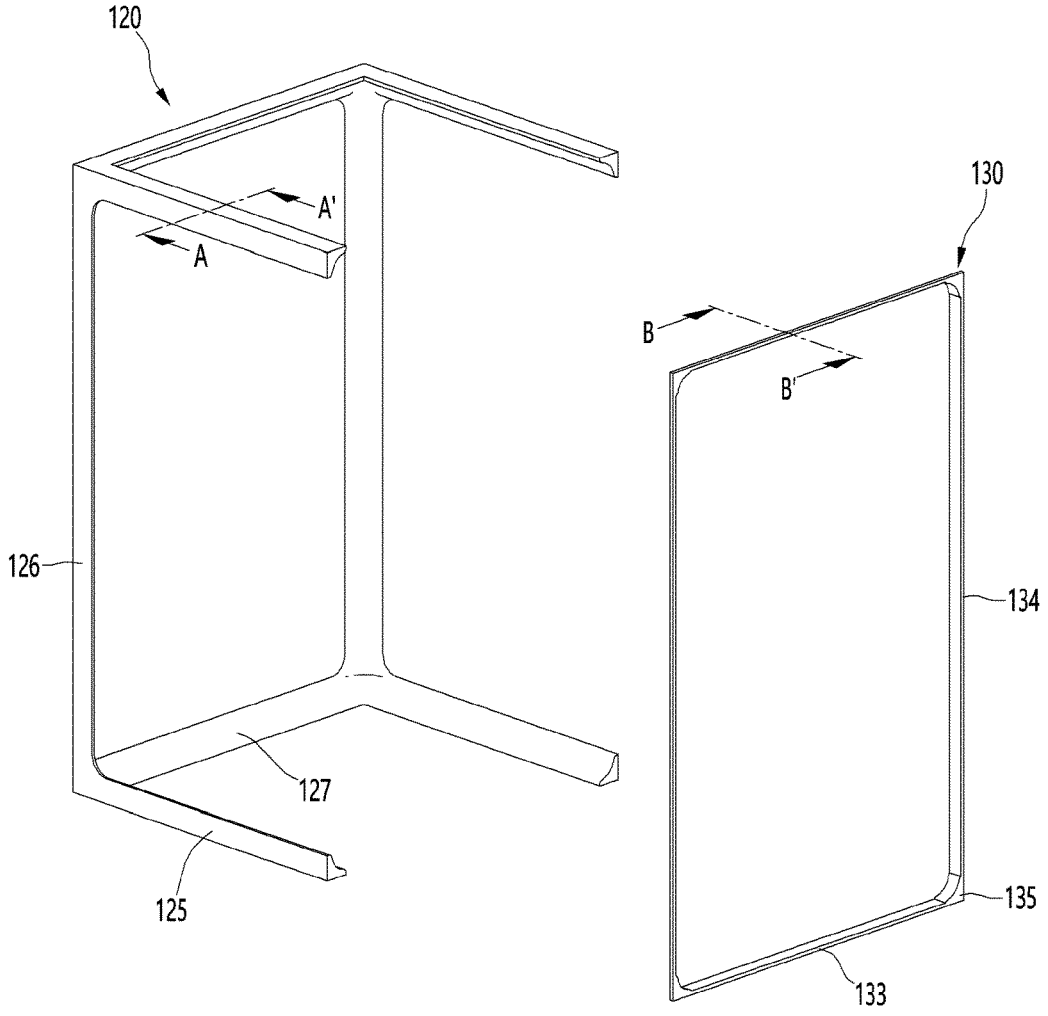
[Fig. 12]
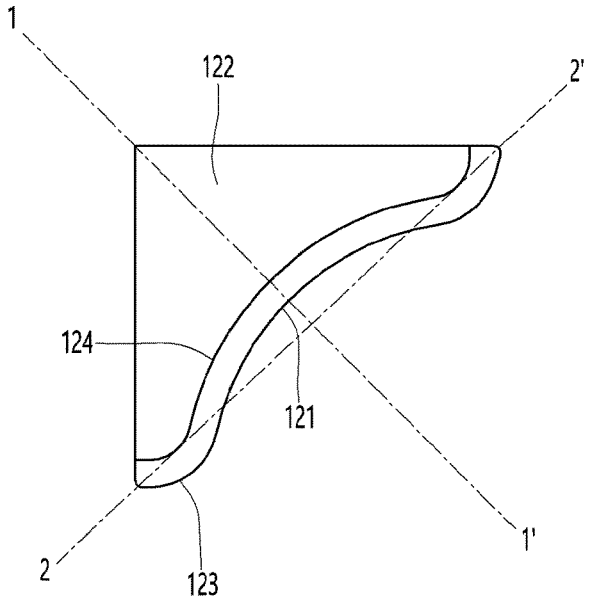

[Fig. 13]
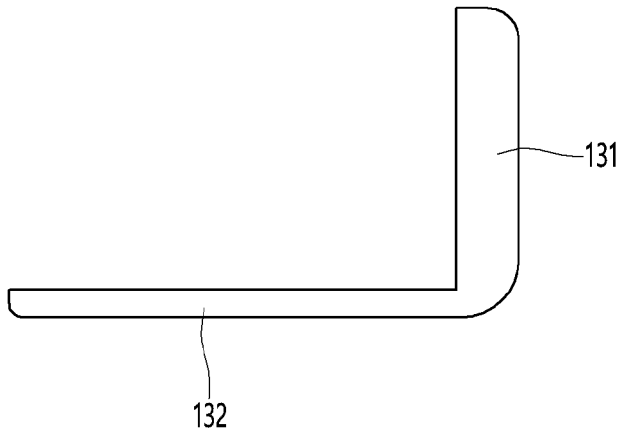
[Fig. 14]
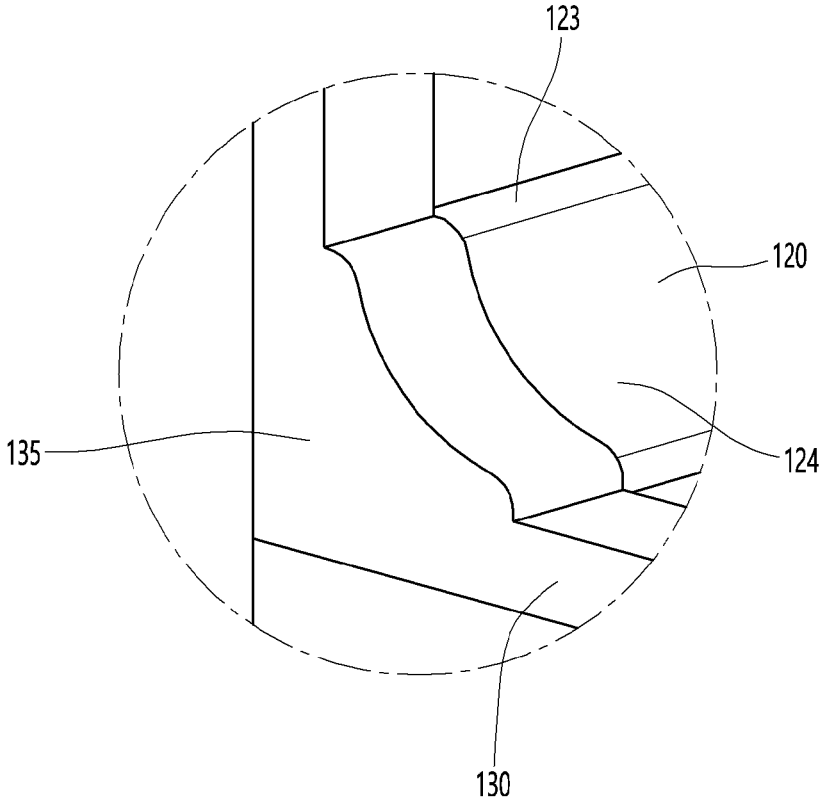

[Fig. 15]
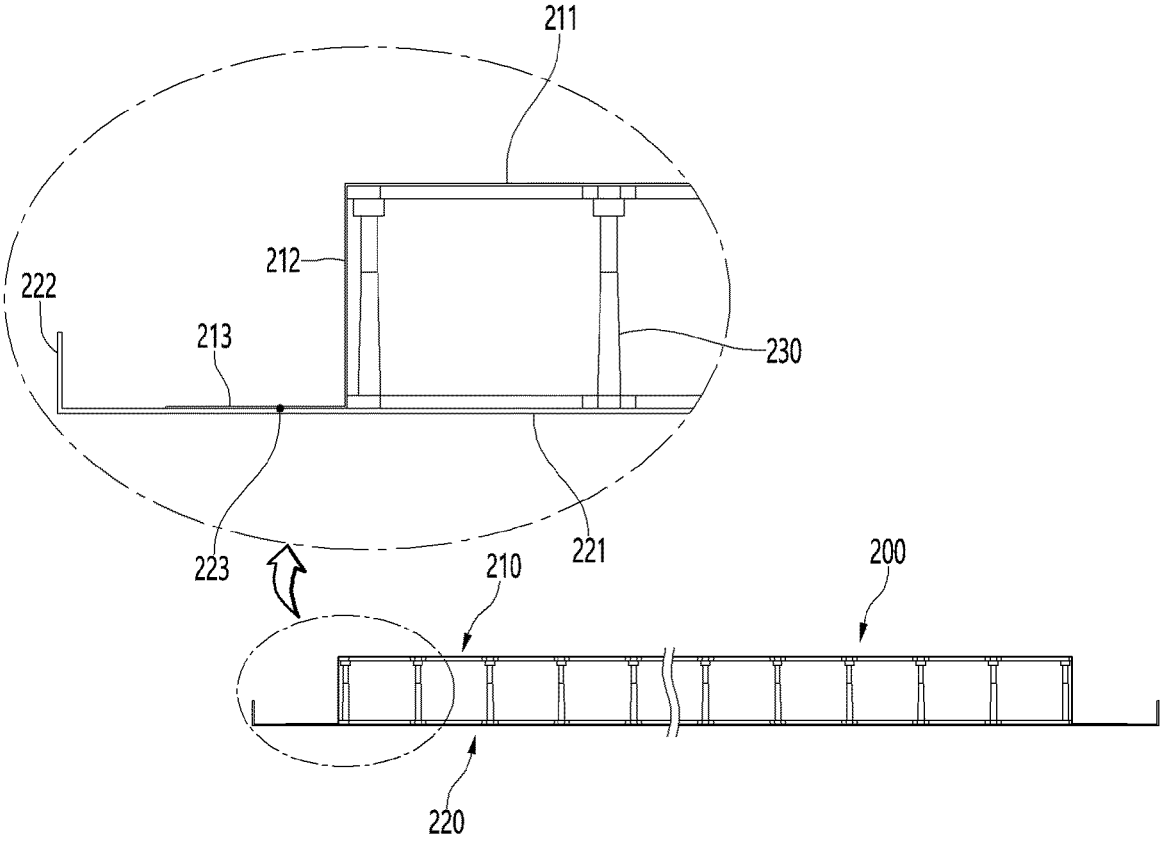
[Fig. 16]
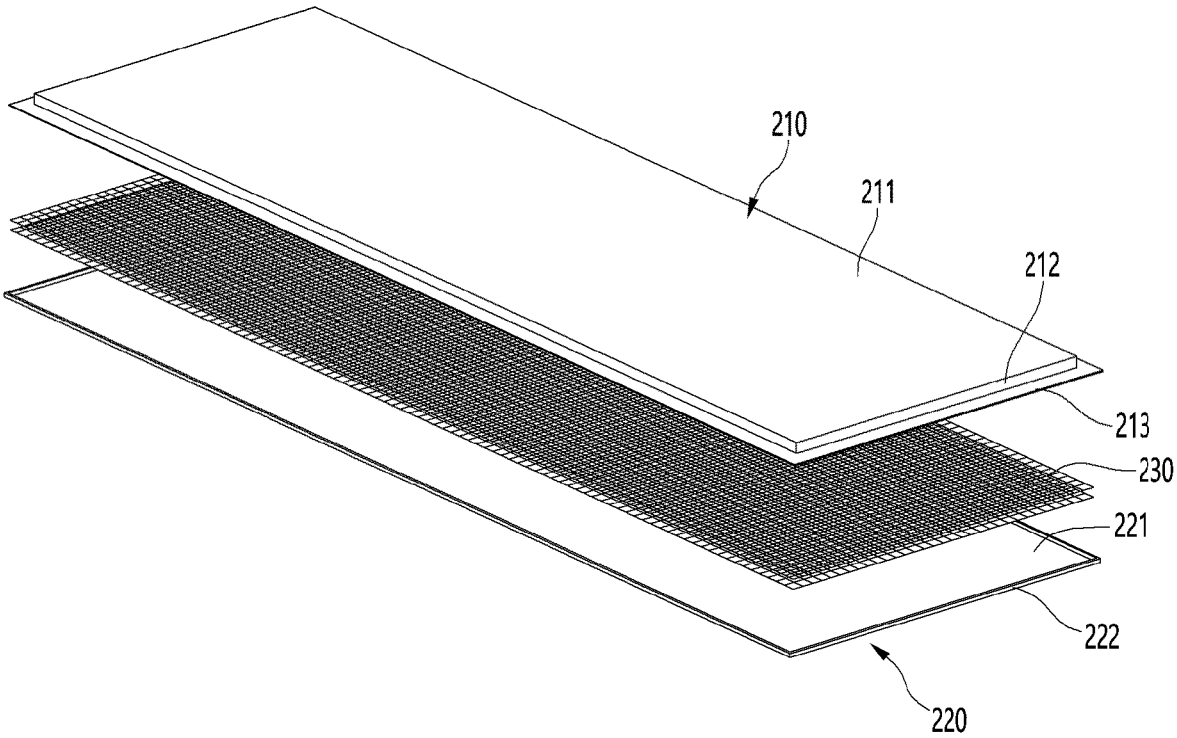

[Fig. 17]
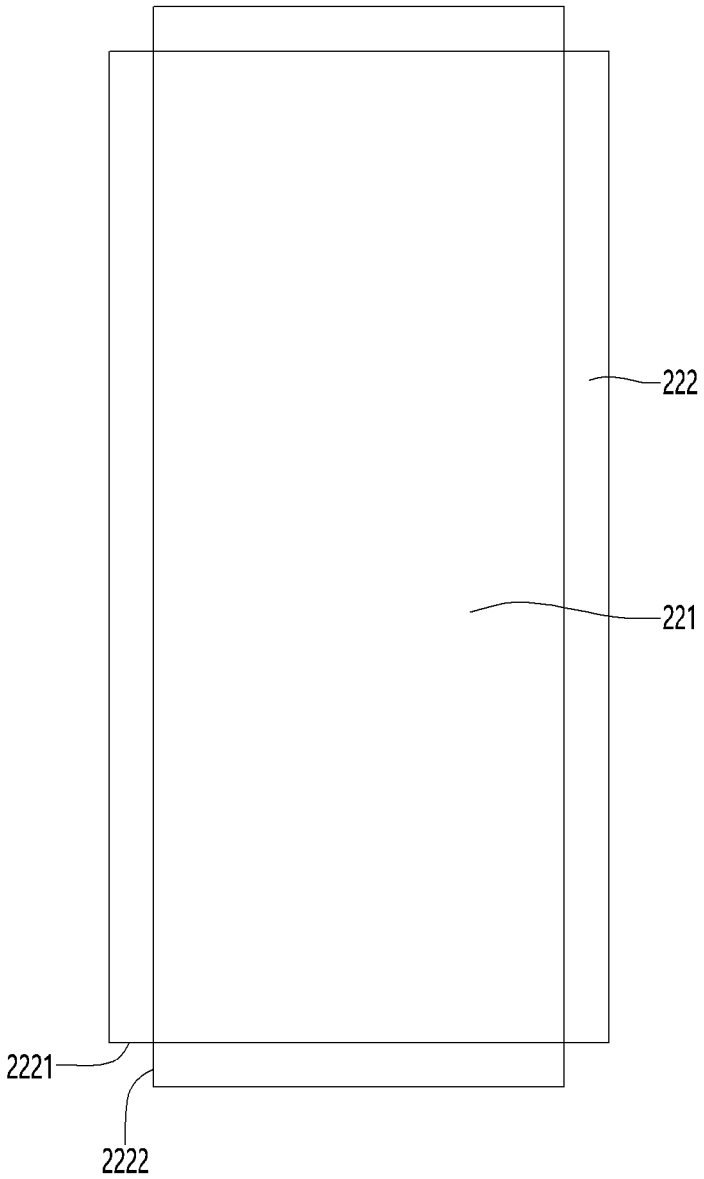

[Fig. 18]
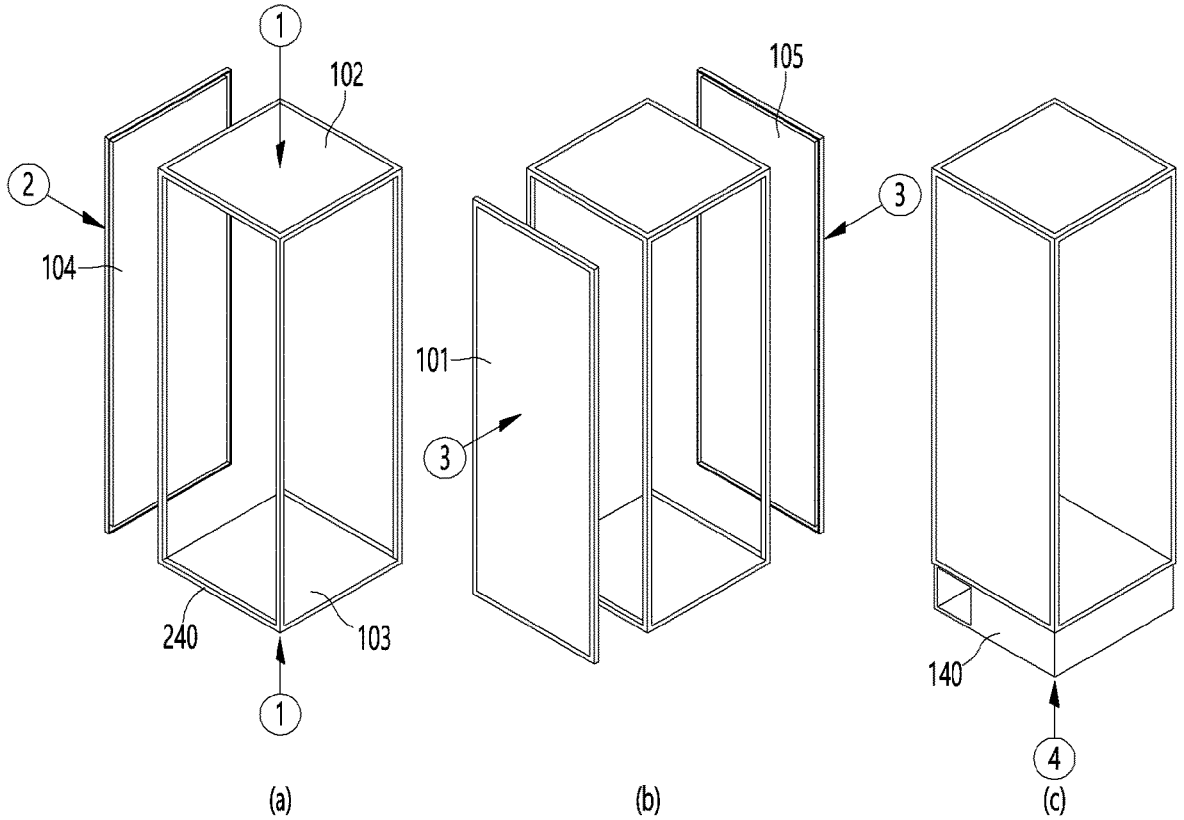

[Fig. 19]
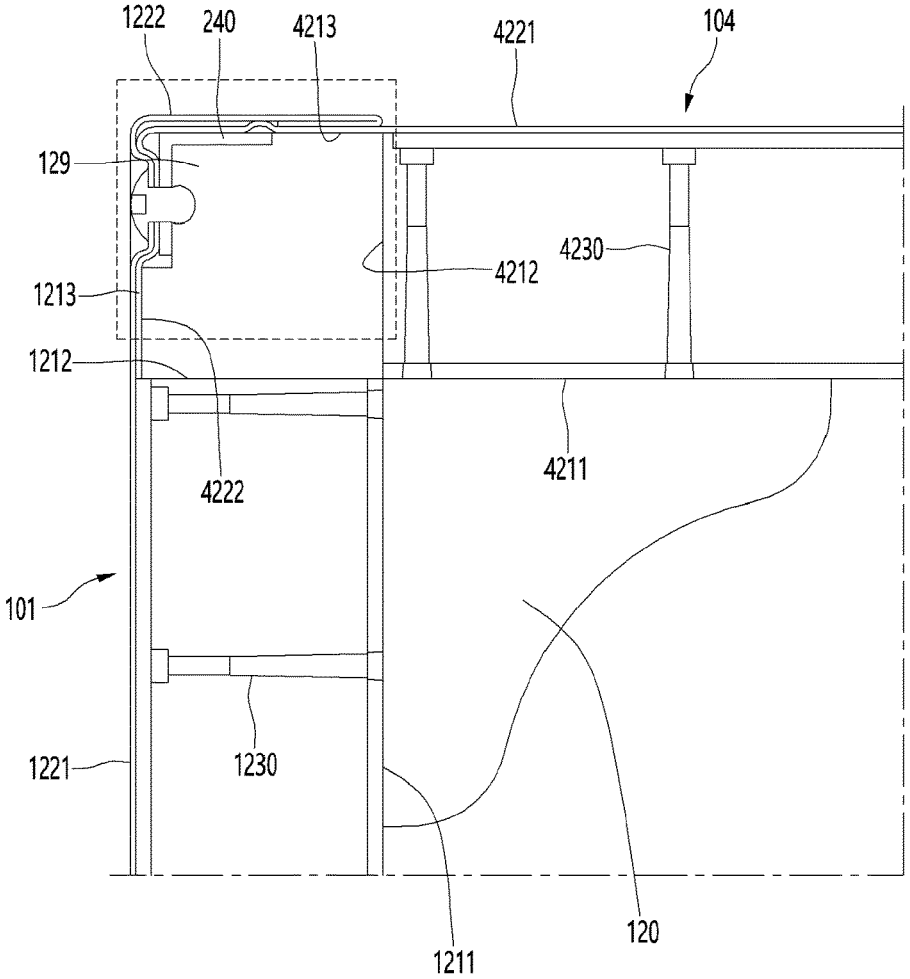
[Fig. 20]
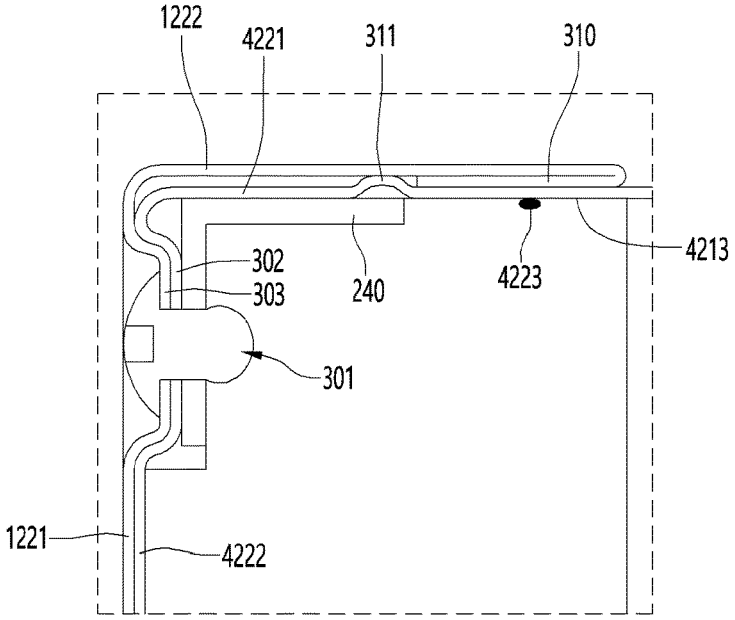

[Fig. 21]
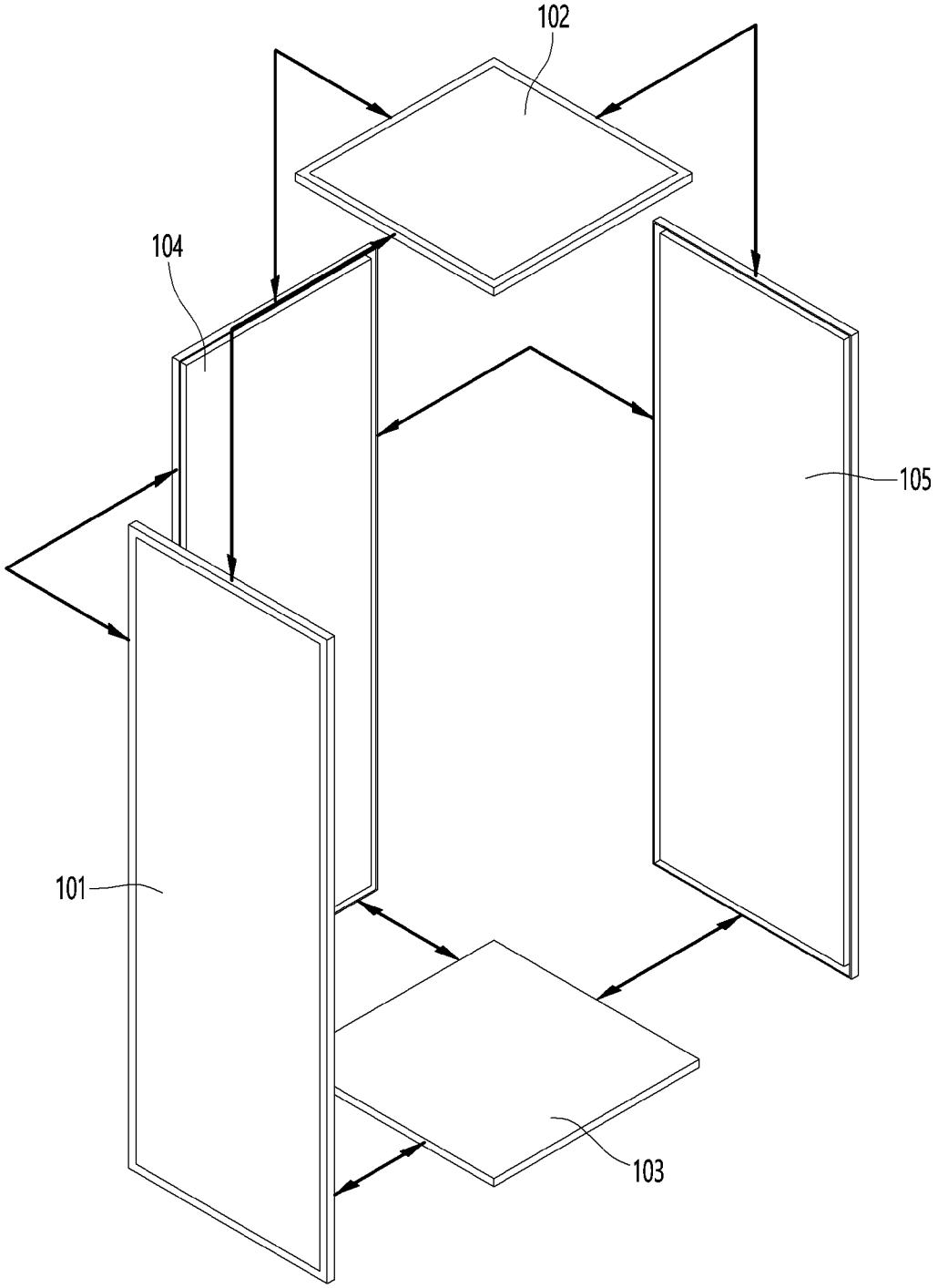

[Fig. 22]
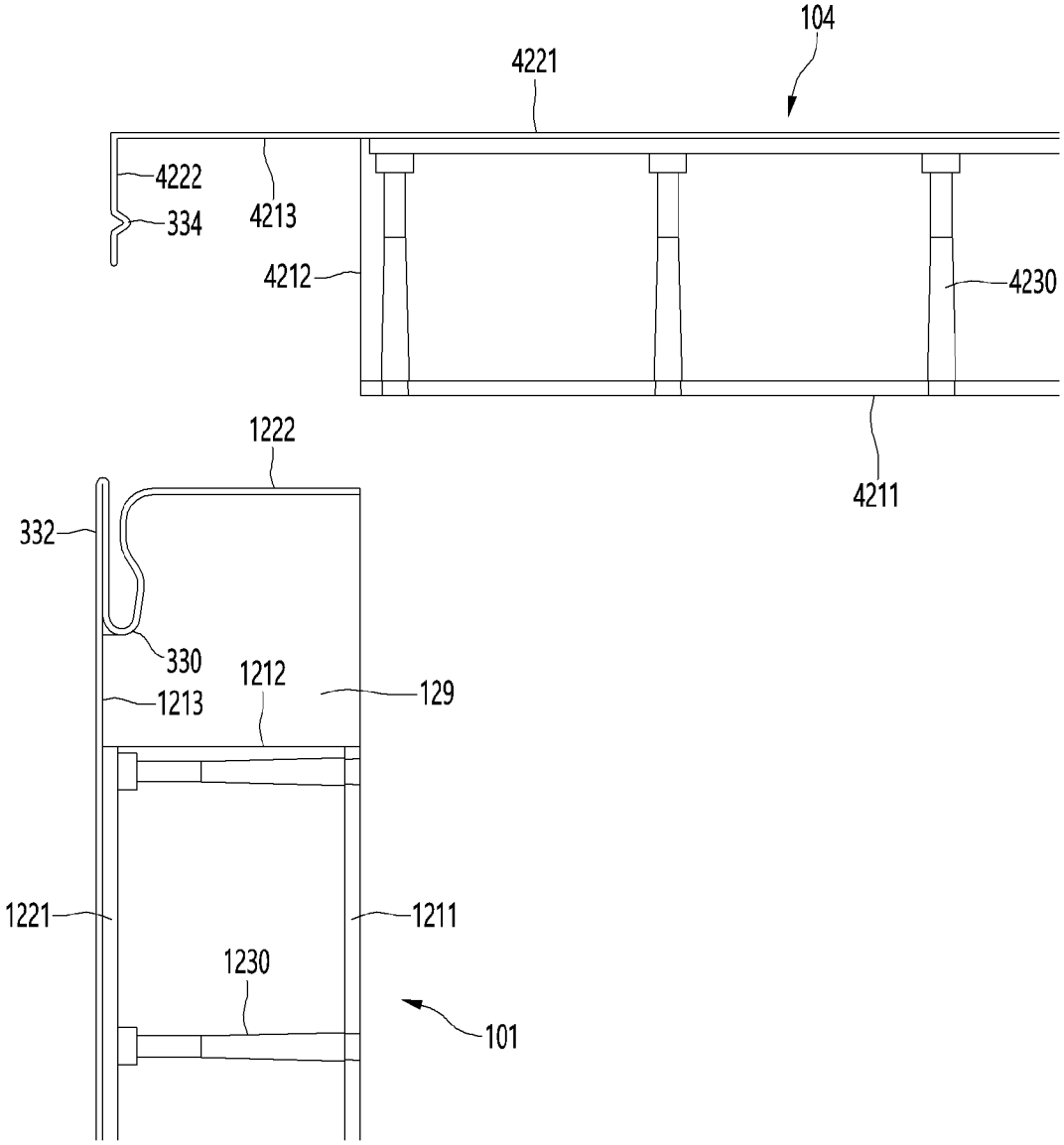

[Fig. 23]
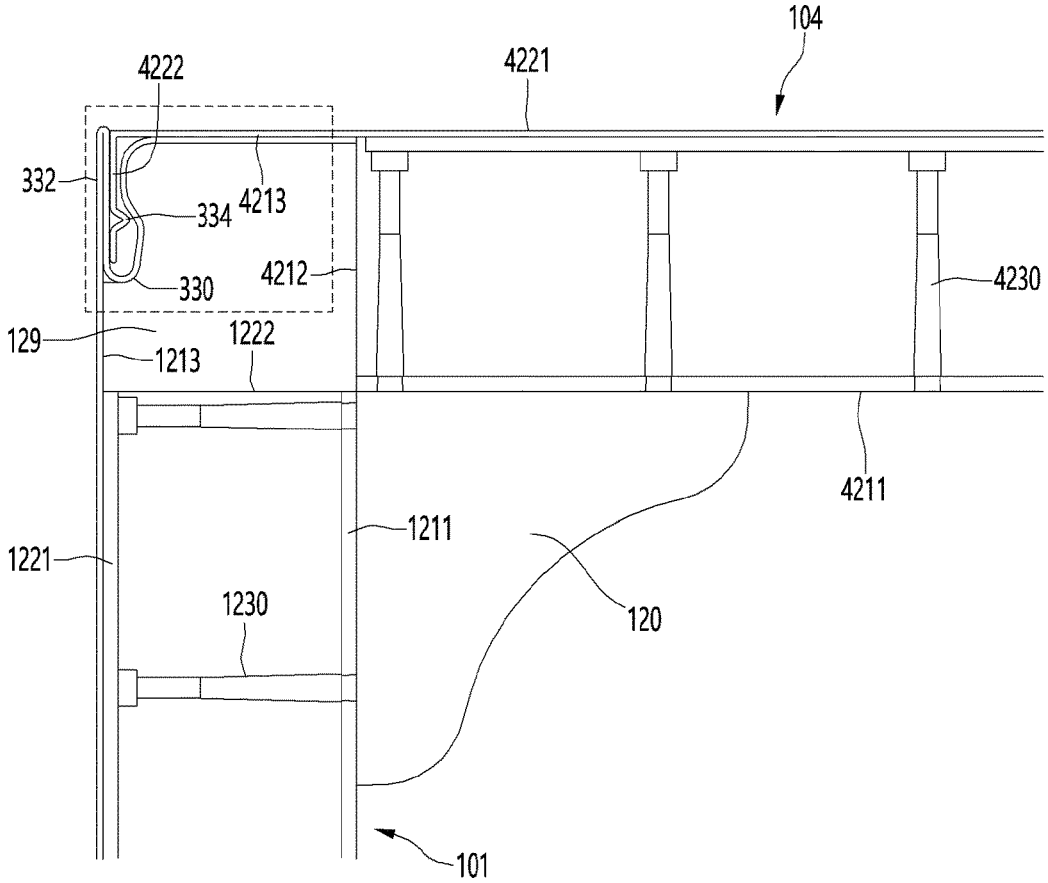
[Fig. 24]
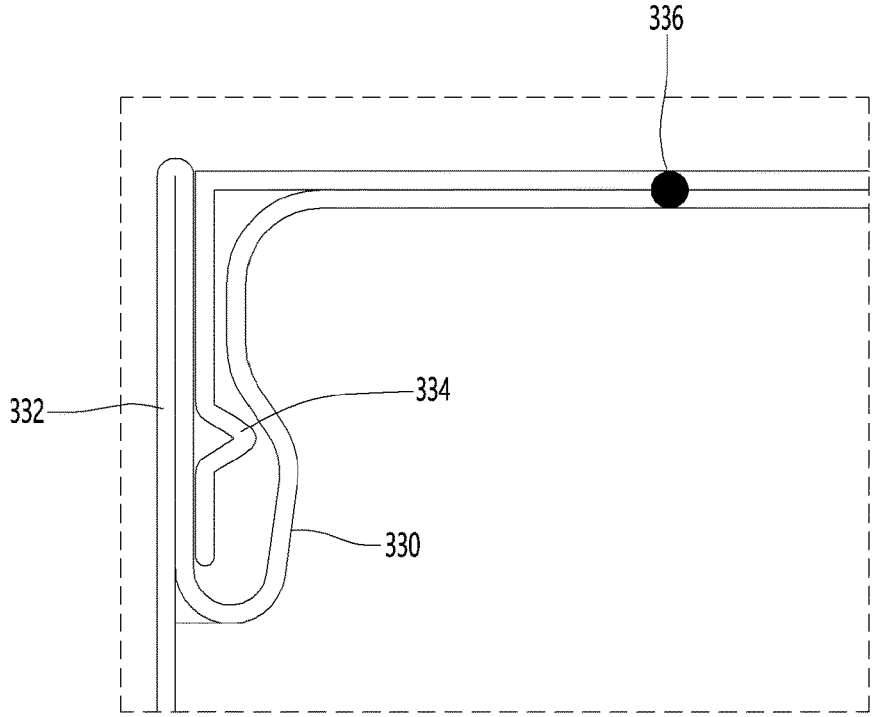

[Fig. 25]
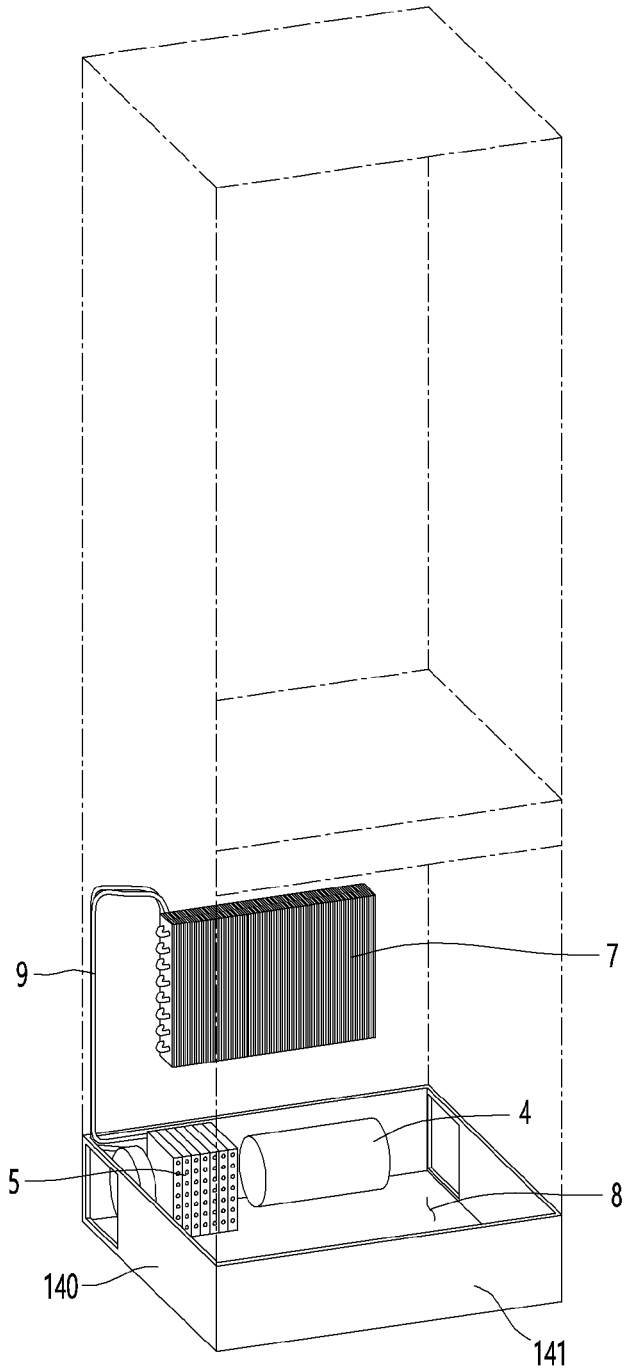

[Fig. 26]
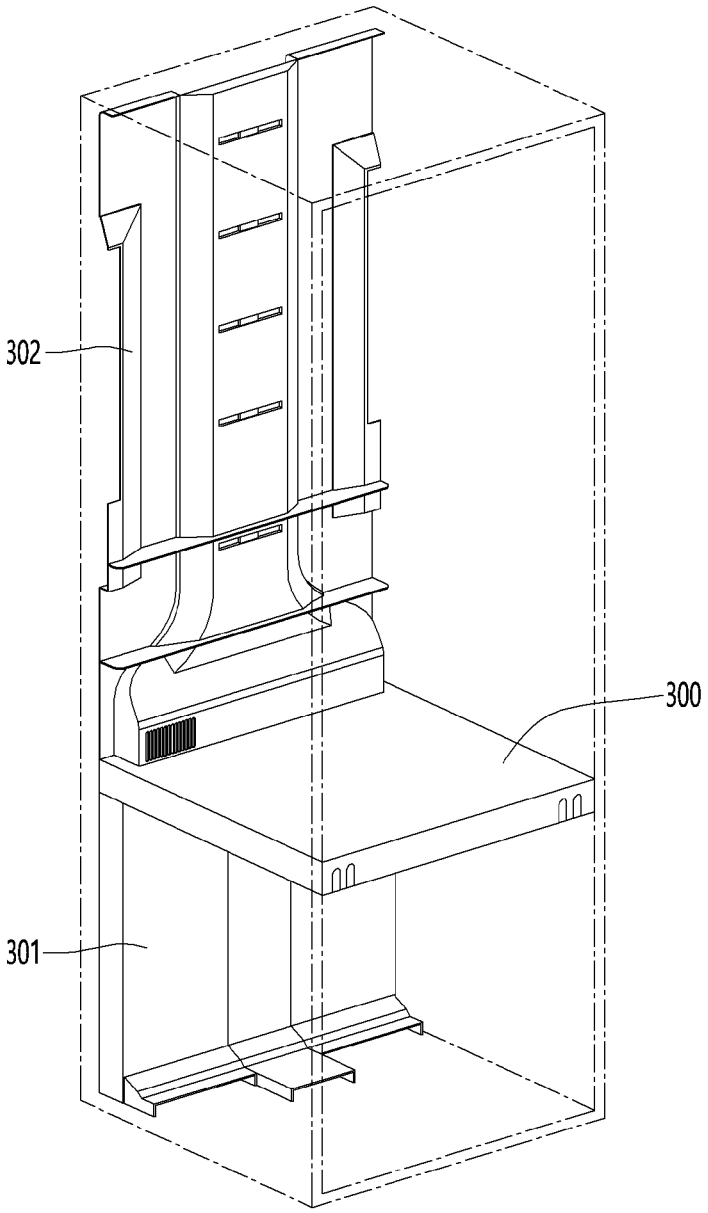

[Fig. 27]
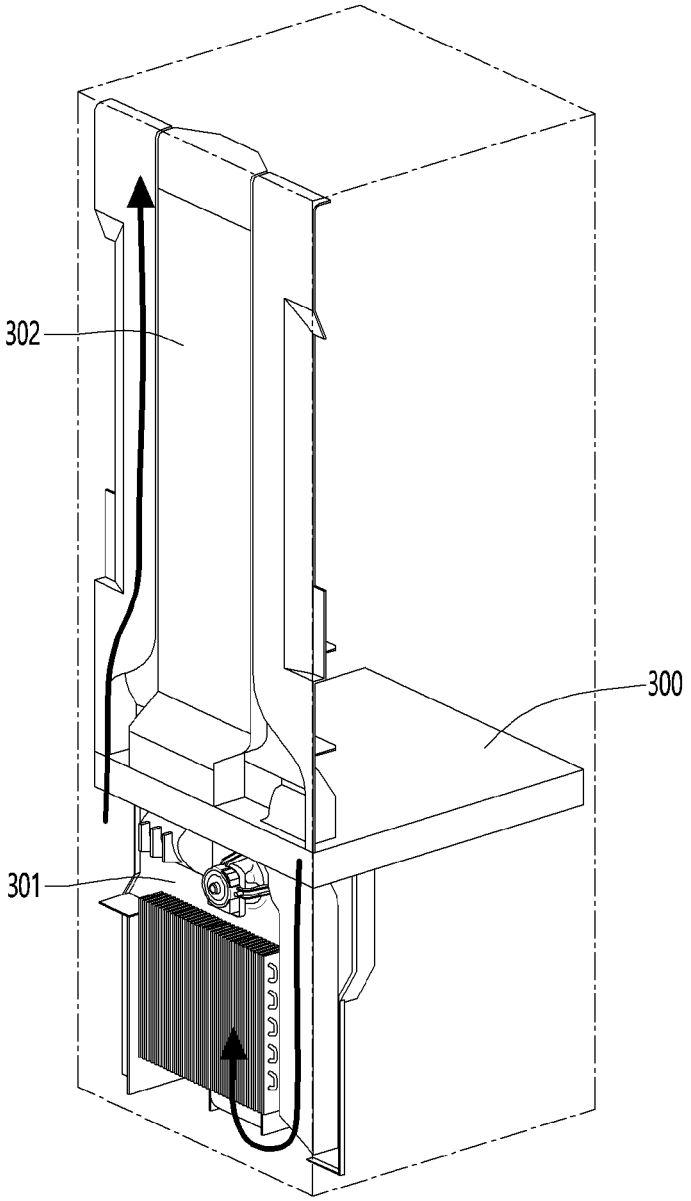

VACUUM ADIABATIC MODULE, REFRIGERATOR, AND METHOD FOR FABRICATING THE REFRIGERATOR

CROSS-REFERENCE TO RELATED PATENT APPLICATIONS

This application is a U.S. National Stage Application under 35 U.S.C. § 371 of PCT Application No. PCT/KR2020/008968, filed Jul. 8, 2020, which claims priority to Korean Patent Application No. 10-2019-0093375, filed Jul. 31, 2019, whose entire subject matters are hereby incorporated by reference.

TECHNICAL FIELD

The present disclosure relates to a vacuum adiabatic module, a refrigerator, and a method for fabricating the refrigerator.

BACKGROUND ART

A vacuum adiabatic body is a product for suppressing heat transfer by vacuuming the inside of a main body thereof. The vacuum adiabatic body may reduce heat transfer by convection and conduction, and hence is applied to heating apparatuses and refrigerating apparatuses. In a typical adiabatic method applied to a refrigerator, although is differently applied in refrigeration and freezing, a foam urethane adiabatic wall having a thickness of about 30 cm or more is generally provided. However, the internal volume of the refrigerator is therefore reduced.

In order to increase the internal volume of a refrigerator, there is an attempt to apply a vacuum adiabatic body to the refrigerator.

First, Korean Patent No. 10-0343719 (Reference Document 1) of the present applicant has been disclosed. According to Reference Document 1, there is disclosed a method in which a vacuum adiabatic panel is prepared and then built in walls of a refrigerator, and the outside of the vacuum adiabatic panel is finished with a separate molding as Styrofoam. According to the method, additional foaming is not required, and the adiabatic performance of the refrigerator is improved. However, fabrication cost increases, and a fabrication method is complicated.

As another example, a technique of providing walls using a vacuum adiabatic material and additionally providing adiabatic walls using a foam filling material has been disclosed in Korean Patent Publication No. 10-2015-0012712 (Reference Document 2). Also, fabrication cost increases, and a fabrication method is complicated.

As further another example, there is an attempt to fabricate all walls of a refrigerator using a vacuum adiabatic body that is a single product. For example, a technique of providing an adiabatic structure of a refrigerator to be in a vacuum state has been disclosed in U.S. Patent Laid-Open Publication No. US2004/0226956A1 (Reference Document 3). However, it is difficult to obtain a practical level of an adiabatic effect by providing a wall of the refrigerator with sufficient vacuum. In detail, there are limitations that it is difficult to prevent a heat transfer phenomenon at a contact portion between an outer case and an inner case having different temperatures, it is difficult to maintain a stable vacuum state, and it is difficult to prevent deformation of a case due to a negative pressure of the vacuum state. Due to these limitations, the technology disclosed in Reference Document 3 is limited to a cryogenic refrigerator, and does not provide a level of technology applicable to general households.

Alternatively, a vacuum adiabatic body and a refrigerator are disclosed in Korean Patent Publication No. 10-2017-0016187 (Reference Document 4). The present technology proposes a refrigerator in which both a main body and a door are provided with a vacuum adiabatic body. The vacuum adiabatic body only performs an adiabatic operation by itself, and the necessary components have to be installed in a product such as a refrigerator to which the vacuum adiabatic body is applied, but this has not been considered.

As another method, a technology in which a plurality of vacuum adiabatic panels are fixed to a frame to provide a vacuum adiabatic body and a refrigerator is disclosed in US Patent Publication No. US2013/0257256A1 (Reference Document 5). The above technique has the following limitations. There is a limitation in that coupling between a vacuum adiabatic panel and a frame is difficult. There is a great risk of an adiabatic loss due to a gap between the vacuum adiabatic panel and the frame due to defective coupling. Since the frame acts as a portion connecting the inside to the outside of the refrigerator, an inner space may be deteriorated in adiabatic efficiency.

DISCLOSURE OF INVENTION

Technical Problem

Embodiments provide a vacuum adiabatic module, in which a component is applied to enable modular processing that is capable of being applied to various places, a refrigerator, and a method for fabricating the refrigerator.

Embodiments also provide a vacuum adiabatic module in which there is little cool air leakage through an adiabatic wall to improve adiabatic efficiency, a refrigerator, and a method for fabricating the refrigerator.

Embodiments also provide a vacuum adiabatic module, in which an amount of heat passing between the inside and the outside of a refrigerator is reduced in fabrication of a refrigerator, a refrigerator, and a method for fabricating the refrigerator.

Solution to Problem

In one embodiment, a vacuum adiabatic body includes: a first plate configured to define at least a portion of a wall for a first space; a second plate configured to define at least a portion of a wall for a second space having a temperature different from that of the first space; a seal configured to seal the first plate and the second plate so as to provide a third space that has a temperature between a temperature of the first space and a temperature of the second space and is in a vacuum state; and a support configured to maintain the third space; Therefore, the vacuum adiabatic module that is thermally insulated with the vacuum, independently applied at various places, and conveniently used may be realized.

The first plate may include: an inner flat plate of which at least a portion is flat, the inner flat plate being configured to define at least a portion of the wall for the first space; a first bent extension bent from an edge of the inner flat plate, the first bent extension extending in a first direction that is directed toward the second space; and a second bent extension which is bent from an edge of the first bent extension and of which at least a portion extends in a second direction in which the second plate extends. The first plate may be conveniently processed and fabricated in various sizes to be conveniently used. The strength of the vacuum adiabatic module may increase.

The second plate may include an outer flat plate of which at least a portion is flat, the outer flat plate being configured to define at least a portion of the wall for the second space. The second plate may be widely provided to conveniently provide a vacuum space.

The first plate may be thinner than the second plate, and thus, the first plate may be faithful to the purpose of reducing an amount of thermal conduction, and the second plate may reinforce insufficient strength to the first plate so that the vacuum adiabatic module is used for multiple purposes.

The seal may be provided on a contact surface between the second bent extension and the outer flat plate. Accordingly, the coupling process of the two portions may be conveniently performed, and there may an advantage in that a tool such as a jig for contact between the portions is not required.

The seal may be provided as a weld portion at which corresponding portions of the second bent extension and the outer flat plate are welded to each other. Accordingly, reliability of maintaining the vacuum may be improved.

The welds may be singly provided to accurately prevent the vacuum from being broken.

The second plate may further include an edge bent extension that is bent from an edge of the outer flat plate to extend toward the first space. Accordingly, the strength of the second plate may further increase, and the coupling between the vacuum adiabatic modules or coupling of peripheral portions may be conveniently performed.

In another embodiment, a refrigerator includes: a main body having an accommodation space and an opening configured to allow access to the accommodation space; and a door configured to open and close the accommodation space, wherein the main body includes: at least two vacuum adiabatic modules connected to each other; and an adiabatic material provided on a portion at which the at least two vacuum adiabatic modules are coupled to each other. Accordingly, standardization of components may be performed to reduces stock costs of the product, and the refrigerator may be fabricated in a convenient process.

Each of the vacuum adiabatic modules may include: a first plate configured to define at least a portion of a wall for the accommodation space; a second plate configured to define at least a portion of a wall for the outer space having a temperature different from that of the accommodation space; a seal configured to seal the first plate and the second plate to provide a vacuum space that has a temperature between a temperature of the accommodation space and a temperature of the outer space and is in a vacuum state; and a support configured to maintain the vacuum space. The number of components required for fabricating the vacuum adiabatic module may be reduced by the vacuum adiabatic module, and the vacuum adiabatic module may be conveniently performed.

The first plate may include: an inner flat plate of which at least a portion is flat; a first bent extension extending from the inner flat plate in a first direction that is directed toward the outer space; and a second bent extension extends from the first bent extension in a second direction in which the second plate extends. Accordingly, the strength of the first plate may be reinforced, and the coupling between the plates may be facilitated.

The second plate may include: an outer bent extension of which at least a portion is flat; and an edge bent extension extending from the outer flat plate toward the accommodation space. Accordingly, the second plate may reinforce the strength, and coupling of necessary components may be conveniently performed.

The adiabatic material may include: an insertion adiabatic material provided in the outer space; and an edge adiabatic frame provided in the accommodation space to reduce thermal conduction through the first plate. Accordingly, an adiabatic material may be provided at an exposed position of the vacuum adiabatic module, that is, the inside and outside of the refrigerator to reduce an adiabatic loss through a connection portion of each of the vacuum adiabatic modules.

A pedestal may be provided below the main body. According to the pedestal, the space within the refrigerator may be provided to be larger, and a space of a lower end of the refrigerator, which is difficult to be approached by the user's hand, may be used as a machine room as a whole.

A machine room drawer in which components constituting a refrigeration system may be accommodated and which is free to access from the pedestal is provided in the pedestal. Accordingly, each component of the refrigeration system may have an advantage of easy access and convenient repair.

The refrigerator may further include a front frame configured to cover an edge of the opening so as to cover a front end of the edge adiabatic frame. Due to the front frame, an outer appearance of the refrigerator may be elegant, and the adiabatic loss may be further reduced.

The edge adiabatic frame may be configured to cover a connection portion to which the vacuum adiabatic module is connected. Accordingly, it is possible to safely protect the side portion of the vacuum adiabatic module that is vulnerable to an impact.

The refrigerator may further include: a thick portion provided by folding an end of the edge bent extension of one vacuum adiabatic module; and a protrusion provided on the outer flat plate of the other vacuum adiabatic module to correspond to an end of the thick portion. Accordingly, there may be an advantage that the coupling of the vacuum adiabatic module is more convenient.

The refrigerator may further include: one recess provided in the outer flat plate of one vacuum adiabatic module; the other recess provided in the edge bent extension of the other vacuum adiabatic module, which corresponds to the one recess; and a main body frame in which a hole into which the coupling portion is inserted is processed, the main body frame being configured to provide a frame of the main body. Accordingly, permanent coupling between the vacuum adiabatic modules may be performed stably, and strong coupling force may be secured.

The one vacuum adiabatic module may a rear surface vacuum adiabatic module configured to provide a rear surface of the main body, and the other vacuum adiabatic module may be a side surface vacuum adiabatic module configured to provide a side surface of the main body. Accordingly, since there are no components exposed to the outside, a gap between the left and right sides of the refrigerator may be reduced, and the left and right spaces of the refrigerator may be secured.

The refrigerator may further include: an insertion pocket having a narrow inlet, the insertion pocket being provided on a connection portion between the outer flat plate of the one vacuum adiabatic module and the edge bent extension of the other vacuum adiabatic module; and the other vacuum adiabatic module comprising the other edge bent extension, the other vacuum adiabatic module having a coupling protrusion inserted into the insertion pocket. Accordingly, coupling of the vacuum adiabatic module may be more convenient, and temporary assembly of the vacuum adiabatic module may be easily performed.

The edge bent extension of the one vacuum adiabatic module and the outer flat plate of the other vacuum adiabatic module may be coupled to each other. Since the strong coupling force is secured, it is possible to firmly maintain the connection of the vacuum adiabatic module.

In further another embodiment, a method for fabricating a refrigerator includes: temporarily assembling at least two vacuum adiabatic modules; coupling the at least two vacuum adiabatic modules to provide a main body of the refrigerator; and coupling a pedestal to a bottom surface of the main body. Accordingly, assembly of the refrigerator may be easily performed.

Each of the vacuum adiabatic modules may include: a first plate; a second plate welded to the first plate at an edge thereof; and a support configured to maintain a distance between the first plate and the second plate, wherein at least one of the first plate or the second plate is provided by bending a two-dimensional flat plate. Accordingly, the vacuum adiabatic, which is a portion for providing the refrigerator, may be fabricated more simply and conveniently.

The two-dimensional flat plate may include: a rectangular outer flat plate; and a wing provided on each of four edges of the outer flat plate. Accordingly, it is possible to easily fabricate a flat plate of the vacuum adiabatic module.

The coupling of the at least two vacuum adiabatic modules may include aligning a main body frame provided along an edge of the main body of the refrigerator with at least a portion of each of the at least two vacuum adiabatic modules so as to be coupled to each other by a coupling portion. Accordingly, it is possible to support a weight of the heavy refrigerator by using the coupling force between the rigid portions.

The coupling of the at least two vacuum adiabatic modules may include aligning at least portions of the at least two vacuum adiabatic module to overlap each other so as to be coupled to each other by a coupling portion. Since each of portions of the modularized vacuum adiabatic module is directly coupled to fabricate the refrigerator, the fabrication may be simple, and a quality of the finished product may be uniformly maintained.

Advantageous Effects of Invention

According to the embodiment, the vacuum adiabatic body may be modularized into the vacuum adiabatic module to reduce the stock costs, be easy in fabrication, improve the productivity, and reduce the costs.

According to the embodiment, since the vacuum adiabatic modules themselves are coupled to each other, and there is no cool air leakage at the coupling interval, the cool air leakage through the adiabatic wall may be prevented to improve the energy efficiency of the refrigerator.

According to the embodiment, the deformation of components due to the high vacuum in fabricating the components for modularization may be prevented to improve the reliability of the finished product.

Therefore, the support may be easily manufactured.

BRIEF DESCRIPTION OF DRAWINGS

FIG. 1 is a perspective view of a refrigerator according to an embodiment.

FIG. 2 is a view schematically illustrating a vacuum adiabatic body used in a main body and a door of the refrigerator.

FIG. 3 is a view illustrating an internal configuration of a vacuum space according to various embodiments.

FIG. 4 is a view illustrating a conductive resistance sheet and a peripheral portion thereof according to various embodiments.

FIG. 5 is a graph illustrating a variation in adiabatic performance and a variation in gas conductivity according to a vacuum pressure by applying a simulation.

FIG. 6 is a graph illustrating results obtained by observing a time and a pressure in a process of exhausting the inside of the vacuum adiabatic body when a support is used.

FIG. 7 is a graph illustrating results obtained by comparing a vacuum pressure to gas conductivity.

FIGS. 8 to 10 are perspective views of a refrigerator according to an embodiment, wherein FIG. 8 is a perspective when viewed from a left side, FIG. 9 is a perspective view when viewed from a right side, and FIG. 10 is a perspective view illustrating a state in which a drawer of a machine room is opened.

FIG. 11 is a view illustrating an arrangement of an edge adiabatic frame and a front panel.

FIG. 12 is a cross-sectional view taken along line A-A' of FIG. 11.

FIG. 13 is a cross-sectional view taken along line B-B' of FIG. 11.

FIG. 14 is a view illustrating a connection relationship between the edge adiabatic frame and the front panel.

FIG. 15 is a cross-sectional view of a vacuum adiabatic module according to an embodiment.

FIG. 16 is an exploded perspective view of the vacuum adiabatic module according to an embodiment.

FIG. 17 is a schematic view illustrating a process of fabricating a plate.

FIGS. 18 to 20 are views illustrating a coupling process of a vacuum adiabatic module according to an embodiment, wherein FIG. 18 is a view illustrating an overall process of coupling vacuum adiabatic modules to each other, FIG. 19 is a cross-sectional view illustrating a process of adjacent coupling vacuum adiabatic modules to each other, and FIG. 20 is an enlarged view of a main portion of FIG. 19.

FIGS. 21 to 24 are views illustrating a coupling process of a vacuum adiabatic module according to another embodiment, wherein FIG. 21 is a view illustrating an overall process of coupling vacuum adiabatic modules to each other, FIG. 22 is a cross-sectional view illustrating a process of adjacent coupling vacuum adiabatic modules to each other, FIG. 23 is a cross-sectional view illustrating a process of adjacent coupling vacuum adiabatic modules to each other, and FIG. 24 is an enlarged view of a coupled main portion.

FIG. 25 is a view for explaining mounting of components of a refrigeration system of the refrigerator according to an embodiment.

FIGS. 26 and 27 are views for explaining front and rear sides of a passage guide guiding cool air to a space within the refrigerator.

MODE FOR THE INVENTION

Hereinafter, exemplary embodiments will be described with reference to the accompanying drawings. The invention may, however, be embodied in many different forms and should not be construed as being limited to the embodiments set forth herein, and a person of ordinary skill in the art, who understands the spirit of the present invention, may readily implement other embodiments included within the scope of the same concept by adding, changing, deleting, and adding components; rather, it will be understood that they are also included within the scope of the present invention.

Hereinafter, for description of embodiments, the drawings shown below may be displayed differently from the actual product, or exaggerated or simple, but this is intended to facilitate understanding of the technical idea of the present invention. It should not be construed as limited. However, it will try to show the actual shape as much as possible.

The following embodiments may be applied to the description of another embodiment unless the other embodiment does not collide with each other, and some configurations of any one of the embodiments may be modified in a state in which only a specific portion is modified in another configuration may be applied.

In the following description, the vacuum pressure means any pressure state lower than the atmospheric pressure. In addition, the expression that a vacuum degree of A is higher than that of B means that a vacuum pressure of A is lower than that of B.

In the following embodiment, an adiabatic module in which a vacuum space is defined may be expressed as a vacuum adiabatic module.

FIG. 1 is a perspective view of a refrigerator according to an embodiment.

Referring to FIG. 1, the refrigerator 1 includes a main body 2 provided with a cavity 9 capable of storing storage goods and a door 3 provided to open/close the main body 2. The door 3 may be rotatably or slidably movably disposed to open/close the cavity 9. The cavity 9 may provide at least one of a refrigerating compartment and a freezing compartment.

Components constituting a refrigeration cycle in which cool air is supplied into the cavity 9. In detail, the components include a compressor 4 for compressing a refrigerant, a condenser 5 for condensing the compressed refrigerant, an expander 6 for expanding the condensed refrigerant, and an evaporator 7 for evaporating the expanded refrigerant to take heat. As a typical structure, a fan may be installed at a position adjacent to the evaporator 7, and a fluid blown from the fan may pass through the evaporator 7 and then be blown into the cavity 9. A freezing load is controlled by adjusting the blowing amount and blowing direction by the fan, adjusting the amount of a circulated refrigerant, or adjusting the compression rate of the compressor, so that it is possible to control a refrigerating space or a freezing space.

FIG. 2 is a view schematically illustrating a vacuum adiabatic body used in the main body and the door of the refrigerator. In FIG. 2, a main body-side vacuum adiabatic body is illustrated in a state in which walls of top and side surfaces are removed, and a door-side vacuum adiabatic body is illustrated in a state in which a portion of a wall of a front surface is removed. In addition, sections of portions at conductive resistance sheets are provided are schematically illustrated for convenience of understanding.

Referring to FIG. 2, the vacuum adiabatic body includes a first plate 10 for providing a wall of a low-temperature space, a second plate 20 for providing a wall of a high-temperature space, a vacuum space 50 defined as a gap between the first and second plates 10 and 20. Also, the vacuum adiabatic body includes the conductive resistance sheets 60 and 63 for preventing thermal conduction between the first and second plates 10 and 20. A seal 61 for sealing the first and second plates 10 and 20 is provided so that the vacuum space 50 is in a sealing state. When the vacuum adiabatic body is applied to a refrigerator or a heating cabinet, the first plate 10 may be referred to as an inner case that is installed inside a control space controlling a temperature, and the second plate 20 may be referred to as an outer case that is installed outside the control space. A machine room 8 in which components providing a refrigeration cycle are accommodated is placed at a lower rear side of the main body-side vacuum adiabatic body, and an exhaust port 40 for forming a vacuum state by exhausting air in the vacuum space 50 is provided at any one side of the vacuum adiabatic body. In addition, a pipeline 64 passing through the vacuum space 50 may be further installed so as to install a defrosting water line and electric wires.

The first plate 10 may define at least a portion of a wall for a first space provided thereto. The second plate 20 may define at least a portion of a wall for a second space provided thereto. The first space and the second space may be defined as spaces having different temperatures. Here, the wall for each space may serve as not only a wall directly contacting the space but also a wall not contacting the space. For example, the vacuum adiabatic body of the embodiment may also be applied to a product further having a separate wall contacting each space.

Factors of heat transfer, which cause loss of the adiabatic effect of the vacuum adiabatic body, are thermal conduction between the first and second plates 10 and 20, heat radiation between the first and second plates 10 and 20, and gas conduction of the vacuum space 50.

Hereinafter, a heat resistance unit provided to reduce adiabatic loss related to the factors of the heat transfer will be provided. Meanwhile, the vacuum adiabatic body and the refrigerator of the embodiment do not exclude that another adiabatic means is further provided to at least one side of the vacuum adiabatic body. Therefore, an adiabatic means using foaming or the like may be further provided to another side of the vacuum adiabatic body.

FIG. 3 is a view illustrating an internal configuration of the vacuum space according to various embodiments.

First, referring to FIG. 3A, the vacuum space 50 may be provided in a third space having a pressure different from that of each of the first and second spaces, preferably, a vacuum state, thereby reducing an adiabatic loss. The third space may be provided at a temperature between the temperature of the first space and the temperature of the second space. Since the third space is provided as a space in the vacuum state, the first and second plates 10 and 20 receive a force contracting in a direction in which they approach each other due to a force corresponding to a pressure difference between the first and second spaces. Therefore, the vacuum space 50 may be deformed in a direction in which the vacuum space 50 is reduced in volume. In this case, the adiabatic loss may be caused due to an increase in amount of heat radiation, caused by the contraction of the vacuum space 50, and an increase in amount of thermal conduction, which is caused by contact between the plates 10 and 20.

The support 30 may be provided to reduce the deformation of the vacuum space 50. The support 30 includes a bar 31. The bar 31 may extend in a substantially vertical direction with respect to the plates to support a distance between the first plate and the second plate. A support plate 35 may be additionally provided on at least any one end of the bar 31. The support plate 35 may connect at least two or more bars 31 to each other to extend in a horizontal direction with respect to the first and second plates 10 and 20. The support plate 35 may be provided in a plate shape or may be provided in a lattice shape so that an area of the support plate contacting the first or second plate 10 or 20 decreases, thereby reducing heat transfer. The bars 31 and the support plate 35 are fixed to each other at at least a portion so as to be inserted together between the first and second plates 10 and 20. The support plate 35 contacts at least one of the first and second plates 10 and 20, thereby preventing the deformation of the first and second plates 10 and 20. In addition, based on the extension direction of the bars 31, a total sectional area of the support plate 35 is provided to be greater than that of the bars 31, so that heat transferred through the bars 31 may be diffused through the support plate 35.

The support 30 may be made of a resin selected from PC, glass fiber PC, low outgassing PC, PPS, and LCP to obtain high compressive strength, a low outgassing and water absorption rate, low thermal conductivity, high compressive strength at a high temperature, and superior processability.

A radiation resistance sheet 32 for reducing heat radiation between the first and second plates 10 and 20 through the vacuum space 50 will be described. The first and second plates 10 and 20 may be made of a stainless material capable of preventing corrosion and providing a sufficient strength. Since the stainless material has a relatively high emissivity of 0.16, a large amount of radiation heat may be transferred. In addition, the support 30 made of the resin has a lower emissivity than the plates, and is not entirely provided to inner surfaces of the first and second plates 10 and 20. Thus, the support 30 does not have great influence on the radiation heat. Therefore, the radiation resistance sheet 32 may be provided in a plate shape over a majority of the area of the vacuum space 50 so as to concentrate on reduction of radiation heat transferred between the first and second plates 10 and 20. A product having a low emissivity may be used as the material of the radiation resistance sheet 32. In an embodiment, an aluminum foil having an emissivity of 0.02 may be used as the radiation resistance sheet 32. Also, since the transfer of radiation heat may not be sufficiently blocked using one radiation resistance sheet, at least two radiation resistance sheets 32 may be provided at a certain distance so as not to contact each other. Also, at least one radiation resistance sheet may be provided in a state of contacting the inner surface of the first or second plate 10 or 20.

Referring back FIG. 3*b*, the distance between the plates is maintained by the support 30, and a porous material 33 may be filled in the vacuum space 50. The porous material 33 may have a higher emissivity than that of the stainless material of the first and second plates 10 and 20. However, since the porous material 33 is filled in the vacuum space 50, the porous material 33 has a high efficiency for resisting the radiation heat transfer.

In this embodiment, the vacuum adiabatic body may be fabricated without the radiation resistance sheet 32.

Referring to FIG. 3*c*, the support 30 for maintaining the vacuum space 50 may not be provided. A porous material 333 may be provided to be surrounded by a film 34 instead of the support 30. Here, the porous material 33 may be provided in a state of being compressed so that the gap of the vacuum space is maintained. The film 34 made of, for example, a PE material may be provided in a state in which a hole is punched in the film 34.

In this embodiment, the vacuum adiabatic body may be fabricated without the support 30. That is to say, the porous material 33 may perform the function of the radiation resistance sheet 32 and the function of the support 30 together.

FIG. 4 is a view illustrating the conductive resistance sheet and the peripheral portion thereof according to various embodiments. A structure of each of the conductive resistance sheets are briefly illustrated in FIG. 2, but will be understood in detail with reference to the drawings.

First, a conductive resistance sheet proposed in FIG. 4*a* may be applied to the main body-side vacuum adiabatic body. Specifically, the first and second plates 10 and 20 are to be sealed so as to vacuum the inside of the vacuum adiabatic body. In this case, since the two plates have different temperatures from each other, heat transfer may occur between the two plates. A conductive resistance sheet 60 is provided to prevent thermal conduction between different two kinds of plates.

The conductive resistance sheet 60 may be provided with the seal 61 at which both ends of the conductive resistance sheet 60 are sealed to define at least a portion of the wall for the third space, and maintain the vacuum state. The conductive resistance sheet 60 may be provided as a thin foil in unit of micrometer so as to reduce the amount of heat conducted along the wall for the third space. The seals 61 may be provided as a weld. That is, the conductive resistance sheet 60 and the plates 10 and 20 may be fused to each other. To cause a fusing operation between the conductive resistance sheet 60 and the plates 10 and 20, the conductive resistance sheet 60 and the plates 10 and 20 may be made of the same material, and a stainless material may be used as the material. The seal 61 may not be limited to the weld and may be provided through a process such as cocking. The conductive resistance sheet 60 may be provided in a curved shape. Thus, a thermal conduction distance of the conductive resistance sheet 60 is provided longer than a linear distance of each of the plates so that an amount of thermal conduction is further reduced.

A change in temperature occurs along the conductive resistance sheet 60. Therefore, to block the heat transfer to the outside of the conductive resistance sheet 60, a shield 62 may be provided at the outside of the conductive resistance sheet 60 so that an adiabatic operation occurs. In other words, in case of the refrigerator, the second plate 20 has a high temperature, and the first plate 10 has a low temperature. In addition, thermal conduction from high temperature to low temperature occurs in the conductive resistance sheet 60, and thus the temperature of the conductive resistance sheet 60 is suddenly changed. Therefore, when the conductive resistance sheet 60 is opened with respect to the outside thereof, the heat transfer through the opened place may seriously occur. To reduce the heat loss, the shield 62 is provided outside the conductive resistance sheet 60. For example, when the conductive resistance sheet 60 is exposed to any one of the low-temperature space and the high-temperature space, the conductive resistance sheet 60 does not serve as a conductive resistor as well as the exposed portion thereof, which is not preferable.

The shield 62 may be provided as a porous material contacting an outer surface of the conductive resistance sheet 60. The shield 62 may be provided as an adiabatic structure, e.g., a separate gasket, which is placed at the outside of the conductive resistance sheet 60. The shield 62 may be provided as a portion of the vacuum adiabatic body, which is provided at a position facing a corresponding conductive resistance sheet 60 when the main body-side vacuum adiabatic body is closed with respect to the door-side vacuum adiabatic body. To reduce the heat loss even when the main body and the door are opened, the shield 62 may be provided as a porous material or a separate adiabatic structure.

Here, the inner surface of the conductive resistance sheet 60 means a surface in which the conductive resistance sheet 60 faces the vacuum space. The outer surface of the conductive resistance sheet 60 may mean a surface that does not face the vacuum space. The definitions of the outer surface and the inner surface may be applied to other portion forming the vacuum space.

A conductive resistance sheet proposed in FIG. 4*b* may be applied to the door-side vacuum adiabatic body. In FIG. 4*b*, portions different from those of FIG. 4*a* are described in detail, and the same description is applied to portions identical to those of FIG. 4*a*. A side frame 70 is further provided outside the conductive resistance sheet 60. A component for the sealing between the door and the main body, an exhaust port necessary for an exhaust process, a getter port for vacuum maintenance, and the like may be placed on the side frame 70. This is because the mounting of components is convenient in the main body-side vacuum adiabatic body, but the mounting positions of components are limited in the door-side vacuum adiabatic body.

In the door-side vacuum adiabatic body, it is difficult to place the conductive resistance sheet 60 on a front end of the vacuum space, i.e., an edge side surface of the vacuum space. This is because, unlike the main body, a corner edge of the door is exposed to the outside. In more detail, if the conductive resistance sheet 60 is placed on the front end of the vacuum space, the corner edge of the door is exposed to the outside, and hence there is a disadvantage in that a separate adiabatic portion has to be configured so as to thermally insulate the conductive resistance sheet 60.

A conductive resistance sheet proposed in FIG. 4*c* may be installed in the pipeline passing through the vacuum space. In FIG. 4*c*, portions different from those of FIGS. 4*a* and 4*b* are described in detail, and the same description is applied to portions identical to those of FIGS. 4*a* and 4*b*. A conductive resistance sheet having the same shape as that of FIG. 4*a*, preferably, a wrinkled conductive resistance sheet 63 may be provided at a peripheral portion of the pipeline 64. Accordingly, a heat transfer path may be lengthened, and deformation caused by a pressure difference may be prevented. In addition, a separate shield may be provided to improve the adiabatic performance of the conductive resistance sheet.

A heat transfer path between the first and second plates 10 and 20 will be described with reference back to FIG. 4*a*. Heat passing through the vacuum adiabatic body may be divided into surface conduction heat ① conducted along a surface of the vacuum adiabatic body, more specifically, the conductive resistance sheet 60, support conduction heat ② conducted along the support 30 provided inside the vacuum adiabatic body, gas conduction heat ③ conducted through an internal gas in the vacuum space, and radiation transfer heat ④ transferred through the vacuum space.

The transfer heat may be changed depending on various depending on various design dimensions. For example, the support may be changed so that the first and second plates 10 and 20 may endure a vacuum pressure without being deformed, the vacuum pressure may be changed, the distance between the plates may be changed, and the length of the conductive resistance sheet may be changed. The transfer heat may be changed depending on a difference in temperature between the spaces (the first and second spaces) respectively provided by the plates. In the embodiment, a preferred configuration of the vacuum adiabatic body has been found by considering that its total heat transfer amount is smaller than that of a typical adiabatic structure formed by foaming polyurethane. In a typical refrigerator including the adiabatic structure formed by foaming the polyurethane, an effective heat transfer coefficient may be proposed as 19.6 mW/mK.

By performing a relative analysis on heat transfer amounts of the vacuum adiabatic body of the embodiment, a heat transfer amount by the gas conduction heat ③ may become the smallest. For example, the heat transfer amount by the gas conduction heat ③ may be controlled to be equal to or smaller than 4% of the total heat transfer amount. A heat transfer amount by solid conduction heat defined as a sum of the surface conduction heat ① and the support conduction heat ② is the largest. For example, the heat transfer amount by the solid conduction heat may reach 75% of the total heat transfer amount. A heat transfer amount by the radiation transfer heat ③ is smaller than the heat transfer amount by the solid conduction heat but larger than the heat transfer amount of the gas conduction heat. For example, the heat transfer amount by the radiation transfer heat ③ may occupy about 20% of the total heat transfer amount.

According to the heat transfer distribution, effective heat transfer coefficients (eK: effective K) (W/mK) of the surface conduction heat ①, the support conduction heat ②, the gas conduction heat ③, and the radiation transfer heat ④ may have an order of Math Equation 1 when comparing the transfer heat ①, ②, ③, and ④.

$$eK_{solid\ conduction\ heat} > eK_{radiation\ conduction\ heat} > eK_{gas\ conduction\ heat} \quad \text{[Equation 1]}$$

Here, the effective heat transfer coefficient (eK) is a value that may be measured using a shape and temperature differences of a target product. The effective heat transfer coefficient (eK) is a value that may be obtained by measuring a total heat transfer amount and a temperature at least one portion at which heat is transferred. For example, a calorific value (W) is measured using a heating source that may be quantitatively measured in the refrigerator, a temperature distribution (K) of the door is measured using heats respectively transferred through a main body and an edge of the door of the refrigerator, and a path through which heat is transferred is calculated as a conversion value (m), thereby evaluating an effective heat transfer coefficient.

The effective heat transfer coefficient (eK) of the entire vacuum adiabatic body is a value given by $k=QL/A\Delta T$. Here, Q denotes a calorific value (W) and may be obtained using a calorific value of a heater. A denotes a sectional area ($m^2$) of the vacuum adiabatic body, L denotes a thickness (m) of the vacuum adiabatic body, and $\Delta T$ denotes a temperature difference.

For the surface conduction heat, a conductive calorific value may be obtained through a temperature difference $\Delta T$ between an entrance and an exit of the conductive resistance sheet 60 or 63, a sectional area A of the conductive resistance sheet, a length L of the conductive resistance sheet, and a thermal conductivity (k) of the conductive resistance sheet (the thermal conductivity of the conductive resistance sheet is a material property of a material and may be obtained in advance). For the support conduction heat, a conductive calorific value may be obtained through a temperature difference $\Delta T$ between an entrance and an exit of the support 30, a sectional area A of the support, a length L of the support, and a thermal conductivity (k) of the support. Here, the thermal conductivity of the support may be a material property of a material and may be obtained in advance. The sum of the gas conduction heat ③, and the radiation transfer heat ④ may be obtained by subtracting the surface conduction heat and the support conduction heat from the heat transfer amount of the entire vacuum adiabatic body. A ratio of the gas conduction heat ③, and the radiation transfer heat ④ may be obtained by evaluating radiation transfer heat when no gas conduction heat exists by remarkably lowering a vacuum degree of the vacuum space 50.

When a porous material is provided inside the vacuum space 50, porous material conduction heat ⑤ may be a sum of the support conduction heat ② and the radiation transfer heat ④. The porous material conduction heat may be changed depending on various variables including a kind, an amount, and the like of the porous material.

According to an embodiment, a temperature difference $\Delta T_1$ between a geometric center formed by adjacent bars 31 and a point at which each of the bars 31 is located may be provided to be less than 0.5° C. Also, a temperature difference $\Delta T_2$ between the geometric center formed by the adjacent bars 31 and an edge of the vacuum adiabatic body may be provided to be less than 0.5° C. In the second plate 20, a temperature difference between an average temperature of the second plate and a temperature at a point at which a heat transfer path passing through the conductive resistance sheet 60 or 63 meets the second plate may be the largest. For example, when the second space is a region hotter than the first space, the temperature at the point at which the heat transfer path passing through the conductive resistance sheet meets the second plate becomes lowest. Similarly, when the second space is a region colder than the first space, the temperature at the point at which the heat transfer path passing through the conductive resistance sheet meets the second plate becomes highest.

This means that the amount of heat transferred through other points except the surface conduction heat passing through the conductive resistance sheet should be controlled, and the entire heat transfer amount satisfying the vacuum adiabatic body may be achieved only when the surface conduction heat occupies the largest heat transfer amount. For this, a temperature variation of the conductive resistance sheet may be controlled to be larger than that of the plate.

Physical characteristics of the components constituting the vacuum adiabatic body will be described. In the vacuum adiabatic body, force due to a vacuum pressure is applied to all of the components. Therefore, a material having a strength ($N/m^2$) of a certain level may be used.

Under such circumferences, the plates 10 and 20 and the side frame 70 may be made of a material having sufficient strength with which the plates 10 and 20 are not damaged by even the vacuum pressure. For example, when the number of bars 31 decreases to limit the support conduction heat, the deformation of each of the plates occurs due to the vacuum pressure, which may bad influence on an outer appearance of the refrigerator. The radiation resistance sheet 32 may be made of a material that has a low emissivity and may be easily subjected to thin film processing. Also, the radiation resistance sheet 32 has to ensure strength enough without being deformed by an external impact. The support 30 is provided to strength that is enough to support the force by the vacuum pressure and endure the external impact, and is to have processability. The conductive resistance sheet 60 may be made of a material that has a thin plate shape and may endure the vacuum pressure.

In an embodiment, the plate, the side frame, and the conductive resistance sheet may be made of stainless materials having the same strength. The radiation resistance sheet may be made of aluminum having weaker strength than that of each of the stainless materials. The support may be made of a resin having weaker strength than that of the aluminum.

Unlike the strength from the point of view of the materials, an analysis from the point of view of stiffness is required. The stiffness (N/m) may be a property that is not be easily deformed. Thus, although the same material is used, its stiffness may vary depending on its shape. The conductive resistance sheets 60 or 63 may be made of a material having strength, but the stiffness of the material may be low so as to increase in heat resistance and minimize the radiation heat as the conductive resistance sheet is uniformly spread without any roughness when the vacuum pressure is applied. The radiation resistance sheet 32 requires stiffness having a certain level so as not to contact another component due to deformation. Particularly, an edge of the radiation resistance sheet may generate the conduction heat due to drooping caused by the self-load of the radiation resistance sheet. Therefore, the stiffness having the certain level is required. The support 30 requires a stiffness enough to endure compressive stress from the plate and the external impact.

In an embodiment, the plate and the side frame may have the highest stiffness so as to prevent the deformation caused by the vacuum pressure. The support, particularly, the bar may have the second highest stiffness. The radiation resistance sheet may have stiffness that is lower than that of the support but higher than that of the conductive resistance sheet. Lastly, the conductive resistance sheet may be made of a material that is easily deformed by the vacuum pressure and has the lowest stiffness.

Even when the porous material 33 is filled in the vacuum space 50, the conductive resistance sheet may have the lowest stiffness, and each of the plate and the side frame may have the highest stiffness.

Hereinafter, the vacuum pressure may be determined depending on internal states of the vacuum adiabatic body. As already described above, a vacuum pressure is to be maintained inside the vacuum adiabatic body so as to reduce heat transfer. Here, it will be easily expected that the vacuum pressure is maintained as low as possible so as to reduce the heat transfer.

The vacuum space may resist to heat transfer by only the support 30. Here, a porous material 33 may be filled with the support inside the vacuum space 50 to resist to the heat transfer. The heat transfer to the porous material may resist without applying the support.

The case in which only the support is applied will be described.

FIG. 5 is a graph illustrating a variation in adiabatic performance and a variation in gas conductivity according to the vacuum pressure by applying a simulation.

Referring to FIG. 5, it may be seen that, as the vacuum pressure decreases, i.e., as the vacuum degree increases, a heat load in the case of only the main body (Graph 1) or in the case in which the main body and the door are combined together (Graph 2) decreases as compared to that in the case of the typical product formed by foaming polyurethane, thereby improving the adiabatic performance. However, it may be seen that the degree of improvement of the adiabatic performance is gradually lowered. Also, it may be seen that, as the vacuum pressure decreases, the gas conductivity (Graph 3) decreases. However, it may be seen that, although the vacuum pressure decreases, a ratio at which the adiabatic performance and the gas conductivity are improved is gradually lowered. Therefore, it is preferable that the vacuum pressure decreases as low as possible. However, it takes long time to obtain an excessive vacuum pressure, and much cost is consumed due to an excessive use of the getter. In the embodiment, an optimal vacuum pressure is proposed from the above-described point of view.

FIG. 6 is a graph illustrating results obtained by observing a time and a pressure in a process of exhausting the inside of the vacuum adiabatic body when the support is used.

Referring to FIG. 6, to create the vacuum space 50 to be in the vacuum state, a gas in the vacuum space 50 is exhausted by a vacuum pump while evaporating a latent gas remaining in the components of the vacuum space 50 through baking. However, if the vacuum pressure reaches a certain level or more, there exists a point at which the level of the vacuum pressure does not increase any more ($\Delta t_1$). Thereafter, the getter is activated by disconnecting the vacuum space 50 from the vacuum pump and applying heat to the vacuum space 50 ($\Delta t_2$). If the getter is activated, the pressure in the vacuum space 50 decreases for a certain period of time, but then normalized to maintain a vacuum pressure having a certain level. The vacuum pressure that maintains the certain level after the activation of the getter is approximately $1.8\times10^{-6}$ Torr.

In the embodiment, a point at which the vacuum pressure does not substantially decrease any more even though the gas is exhausted by operating the vacuum pump is set to the lowest limit of the vacuum pressure used in the vacuum adiabatic body, thereby setting the minimum internal pressure of the vacuum space 50 to $1.8\times10^{-6}$ Torr.

FIG. 7 is a graph illustrating results obtained by comparing the vacuum pressure with gas conductivity.

Referring to FIG. 7, gas conductivity with respect to the vacuum pressure depending on a size of the gap in the vacuum space 50 was represented as a graph of effective heat transfer coefficient (eK). The effective heat transfer coefficient (eK) was measured when the gap in the vacuum space 50 has three sizes of 2.76 mm, 6.5 mm, and 12.5 mm. The gap in the vacuum space 50 is defined as follows. When the radiation resistance sheet 32 exists inside surface vacuum space 50, the gap is a distance between the radiation resistance sheet 32 and the plate adjacent thereto. When the radiation resistance sheet 32 does not exist inside surface vacuum space 50, the gap is a distance between the first and second plates.

It was seen that, since the size of the gap is small at a point corresponding to a typical effective heat transfer coefficient of 0.0196 W/mK, which is provided to an adiabatic material formed by foaming polyurethane, the vacuum pressure is $2.65\times10^{-1}$ Torr even when the size of the gap is 2.76 mm. Meanwhile, it was seen that the point at which reduction in adiabatic effect caused by the gas conduction heat is saturated even though the vacuum pressure decreases is a point at which the vacuum pressure is approximately $4.5\times10^{-3}$ Torr. The vacuum pressure of $4.5\times10^{-3}$ Torr may be defined as the point at which the reduction in adiabatic effect caused by the gas conduction heat is saturated. Also, when the effective heat transfer coefficient is 0.1 W/mK, the vacuum pressure is $1.2\times10^{-2}$ Torr.

When the vacuum space 50 is not provided with the support but provided with the porous material, the size of the gap ranges from a few micrometers to a few hundreds of micrometers. In this case, the amount of radiation heat transfer is small due to the porous material even when the vacuum pressure is relatively high, i.e., when the vacuum degree is low. Therefore, an appropriate vacuum pump is used to adjust the vacuum pressure. The vacuum pressure appropriate to the corresponding vacuum pump is approximately $2.0\times10^{-4}$ Torr. Also, the vacuum pressure at the point at which the reduction in adiabatic effect caused by the gas conduction heat is saturated is approximately $4.7\times10^{-2}$ Torr. Also, the pressure where the reduction in adiabatic effect caused by gas conduction heat reaches the typical effective heat transfer coefficient of 0.0196 W/mK is 730 Torr.

When the support and the porous material are provided together in the vacuum space, a vacuum pressure may be created and used, which is middle between the vacuum pressure when only the support is used and the vacuum pressure when only the porous material is used. When only the porous material is used, the lowest vacuum pressure may be used.

The vacuum adiabatic body includes a first plate defining at least a portion of a wall for the first space and a second plate defining at least a portion of a wall for the second space and having a temperature different from the first space. The first plate may include a plurality of layers. The second plate may include a plurality of layers The vacuum adiabatic body may further include a seal configured to seal the first plate and the second plate so as to provide a third space that is in a vacuum state and has a temperature between a temperature of the first space and a temperature of the second space.

When one of the first plate and the second plate is disposed in an inner space of the third space, the plate may be represented as an inner plate. When the other one of the first plate and the second plate is disposed in an outer space of the third space, the plate may be represented as an outer plate. For example, the inner space of the third space may be a storage room of the refrigerator. The outer space of the third space may be an outer space of the refrigerator.

The vacuum adiabatic body may further include a support that maintains the third space.

The vacuum adiabatic body may further include a conductive resistance sheet connecting the first plate to the second plate to reduce an amount of heat transferred between the first plate and the second plate.

At least a portion of the conductive resistance sheet may be disposed to face the third space. The conductive resistance sheet may be disposed between an edge of the first plate and an edge of the second plate. The conductive resistance sheet may be disposed between a surface on which the first plate faces the first space and a surface on which the second plate faces the second space. The conductive resistance sheet may be disposed between a side surface of the first plate and a side surface of the second plate.

At least a portion of the conductive resistance sheet may extend in a direction that is substantially the same as the direction in which the first plate extends.

A thickness of the conductive resistance sheet may be thinner than at least one of the first plate or the second plate. The more the conductive resistance sheet decreases in thickness, the more heat transfer may decrease between the first plate and the second plate.

The more the conductive resistance sheet decreases in thickness, the more it may be difficult to couple the conductive resistance sheet between the first plate and the second plate.

One end of the conductive resistance sheet may be disposed to overlap at least a portion of the first plate. This is to provide a space for coupling one end of the conductive resistance sheet to the first plate. Here, the coupling method may include welding.

The other end of the conductive resistance sheet may be arranged to overlap at least a portion of, the second plate. This is to provide a space for coupling the other end of the conductive resistance sheet to the second plate. Here, the coupling method may include welding.

As another embodiment of replacing the conductive resistance sheet, the conductive resistance sheet may be deleted, and one of the first plate and the second plate may be thinner than the other. In this case, a thickness of one plate may be greater than that of the conductive resistance sheet. In this case, a length of one plate may be greater than that of the conductive resistance sheet. With this configuration, it is possible to reduce the increase in heat transfer by deleting the conductive resistance sheet. Also, this configuration may reduce difficulty in coupling the first plate to the second plate.

At least a portion of the first plate and at least a portion of the second plate may be disposed to overlap each other. This is to provide a space for coupling the first plate to the second plate. An additional cover may be disposed on any one of the first plate and the second plate, which has a thin thickness. This is to protect the thin plate.

The vacuum adiabatic body may further include an exhaust port for discharging a gas in the vacuum space.

Hereinafter, according to an embodiment, as a product that may be widely used in adiabatic products such as refrigerators, a vacuum adiabatic module to which the technology of the vacuum adiabatic body is applied will be described.

The vacuum adiabatic module is a modularized component to enable high adiabatic performance due to a low vacuum pressure to be used for many adiabatic products. The vacuum adiabatic module may be applied as one component of the adiabatic product such as the vacuum adiabatic body and the refrigerator. The vacuum adiabatic body and the vacuum adiabatic module may be used similarly, but the vacuum adiabatic module may be more versatile than the vacuum adiabatic body and be different from the vacuum adiabatic body in that the vacuum adiabatic effect is achieved only by being mounted in various other applications.

In the description of the following embodiments, it is illustrated that the refrigerator is provided using the vacuum adiabatic module. The application of the vacuum adiabatic module is not limited to the refrigerator, but may be applied to various vacuum adiabatic products. In the following description, in the following description, a description with respect to the preferred place of use may be added as the name of the door and the main body, but this is for understanding the contents and should not be interpreted limitedly in the name. Also, the expression such as first and second may be used to indicate meanings that are distinguished from each other rather than to indicate order or importance.

In the description of the following embodiments, the vacuum adiabatic module may be provided as a wall portion having the vacuum space therein as a modularized portion as a whole, but is not limited thereto, and additional components or additional processing may be performed on the edge or the like. However, since the vacuum adiabatic body is a portion that is characterized by having a two-dimensional extension structure to provide an adiabatic wall, a cross-sectional view will be mainly described, and a characteristic portion in the cross-section will be described more intensively.

A refrigerator according to an embodiment, to which the vacuum adiabatic module is applied, will be described below.

FIGS. 8 to 10 are perspective views of the refrigerator according to an embodiment, wherein FIG. 8 is a perspective when viewed from a left side, FIG. 9 is a perspective view when viewed from a right side, and FIG. 10 is a perspective view illustrating a state in which a drawer of a machine room is opened.

Referring to FIGS. 8 to 10, in the refrigerator according to the embodiment, each vacuum adiabatic module may thermally insulate a wall surface of the refrigerator. A connection portion provided at each of edges of each vacuum adiabatic module may be connected to each other to provide an adiabatic space inside the refrigerator. The vacuum adiabatic module may provide walls of each plane constituting the refrigerator body.

A top surface adiabatic module 102, a bottom surface vacuum adiabatic module 103, a side surface vacuum adiabatic modules 101 and 105, and a rear surface vacuum adiabatic module 104 may be coupled and provided to the wall surface of the main body of the refrigerator 100. Although not shown, a door may be provided in front of the main body. The door may be provided as a vacuum adiabatic module.

The vacuum adiabatic modules 101, 102, 103, 104, and 105 may be provided in different sizes. Connection portions of the vacuum adiabatic modules may be coupled to each other. The connection portion of the rear surface vacuum adiabatic module 104 may cover the connection portion of the top surface vacuum adiabatic module 102 and the connection portion of the bottom surface vacuum adiabatic module 103. The connection portion of the side surface vacuum adiabatic modules 101 and 105 may cover the connection portion of the rear surface vacuum adiabatic module 104, the connection portion of the top surface vacuum adiabatic module 102, and the connection portion of the bottom surface vacuum adiabatic module 103.

Accordingly, the side surface of the refrigerator may be provided in the form of a flat plane. In other words, due to the configuration of the connection portion is not exposed to the side surface of the refrigerator and the overlapping of the connection portions, the side surface of the refrigerator may not increase in thickness. Accordingly, the refrigerator may be conveniently installed in a narrow space to the left and right, and the size of the refrigerator in a left and right direction may be largely provided so that a space for storing items inside the refrigerator is larger.

The vacuum adiabatic module will be described in detail later.

A pedestal 140 may be provided below the refrigerator. The pedestal 140 may be disposed on a lower portion to support the refrigerator. Components providing a refrigeration system may be accommodated inside the pedestal 140. A vent hole 142 may be provided in each of both sides of the pedestal. The air required for heat exchange of the refrigeration system may be introduced in one direction and then discharged in the other direction through the vent hole 142.

The pedestal 140 is provided with a machine room drawer 141 on which components providing a refrigeration system are placed. The machine room drawer 141 may be conveniently drawn in and out of the pedestal 140. The machine room drawer 141 may be slid with respect to the pedestal 140 and be withdrawn from or inserted into the refrigerator.

An edge adiabatic frames 120 are provided at each edge of the inner space of the refrigerator body. The edge adiabatic frame 120 may reduce an adiabatic loss that may occur at each connection portion of the vacuum adiabatic module.

The front panel 130 may cover the exposed portions of the front ends of the side surface vacuum adiabatic modules 101 and 105, the bottom surface vacuum adiabatic module 103, and the top surface vacuum adiabatic module 102. The front panel 130 may reduce the adiabatic loss through the edge of the vacuum adiabatic module.

A front panel 130 covering the front end of the edge adiabatic frame 120 may be provided. The front panel 130 may cover four spaced points of the edge adiabatic frame 120. The front panel 130 may reinforce strength of the point, which is vulnerable to share stress, of the edge adiabatic frame 120 having weak stiffness and reduce the adiabatic loss through the edge adiabatic frame.

FIG. 11 is a view illustrating an arrangement of the edge adiabatic frame and the front panel.

Referring to FIG. 11, the edge adiabatic frame 120 includes each extension blocking an inner edge of the refrigerator body. The edge adiabatic frame 120 may have front and rear extensions 125, vertical extensions 126, and left and right extensions 127, which respectively extend along the front and rear edges, the upper and lower edges, and the left and right edges of the inner surface of the refrigerator body.

An adiabatic materials may be provided in the front and rear extensions 125, the vertical extensions 126, and the left and right extensions 127. It is possible to reduce the adiabatic loss through the connection portion to which the vacuum adiabatic module is connected by the adiabatic material.

FIG. 12 is a cross-sectional view taken along line A-A' of FIG. 11. Referring to FIG. 12, the edge adiabatic frame 120 includes an edge adiabatic material 122 having an inner shape corresponding to the shape of each edge of the refrigerator body and an edge frame 121 protecting the outside of the edge adiabatic material 122, i.e., the other surface exposed to the inner space of the refrigerator.

One surface of the edge adiabatic material 122 may be bent at an angle of about 90 degrees so that a pair of vacuum adiabatic modules cover corner portions that cross each other at an angle of about 90 degrees. The other surfaces of the edge adiabatic material 122 may have a shape symmetrical to each other with respect to a center line 1-1' of one surface of the edge adiabatic material. Accordingly, the adiabatic loss may be further reduced.

The other surface of the edge adiabatic material may include an adiabatic expansion 123 that is provided convexly outside the connection line to quickly increase in adiabatic effect with respect to a connection line 2-2' connecting an end of one surface of the edge adiabatic material. An adiabatic contraction 124 that is convexly provided to the inside of the connection line and be relatively contracted when compared to the connection line may be disposed inside the adiabatic expansion 123.

A distance from the edge adiabatic material 122 to the vacuum adiabatic module from the inner space of the refrigerator body is farther from the adiabatic contraction 124 than the adiabatic expansion 123. Therefore, adiabatic performance according to an adiabatic thickness is greater than that of the adiabatic contraction 124 than the adiabatic expansion 123.

The adiabatic expansion 123 may rapidly expand the adiabatic thickness so that the adiabatic performance of the edge of the edge adiabatic material 122 rapidly increases. Since the adiabatic contraction 124 has an adiabatic thickness greater than that of the adiabatic expansion 123, there is no difficulty in adiabatic performance. The adiabatic contraction 124 may be provided to be convex inward with respect to the connection line 2-2' to reinforce the overall strength of the edge adiabatic frame 120, and thus, the inner space of the refrigerator body may increase.

The edge adiabatic material 122 may be a portion made of lightweight polyurethane, and a portion having many pores may be processed and provided. An edge frame 121 is provided on the other surface of the edge adiabatic material 122. The edge frame 121 may reinforce strength using an ABS resin or the like. The overall strength of the edge adiabatic frame may be reinforced by the edge frame 121, and since an external impact is not applied to the edge adiabatic material, the performance of the edge adiabatic material may be prevented from being deteriorated.

The edge frame 121 may wrap the edge adiabatic material 122 as a whole to increase in strength of the edge adiabatic frame. In this case, the edge frame 121 may prevent moisture within the refrigerator from permeated into the edge adiabatic material 122, thereby preventing the adiabatic performance of the edge adiabatic material from being deteriorated.

Referring again to FIG. 11, the front frame 130 is provided with a left and right extension 133 extending in the left and right directions and a vertical extension 134 extending in a vertical direction. The left and right extension 133 and the vertical extension 134 may cover the front end of the vacuum adiabatic module to protect the end of the vacuum adiabatic module and prevent the adiabatic loss of the vacuum adiabatic module from occurring.

The left and right extension 133 and the vertical extension 134 may be connected to each other by a corner connection portion 135.

A front end of the front and rear extension 125 may be covered by the corner connection portion 135 of the front frame 130. The corner connection portion 135 may be provided in a shape corresponding to the front end of the front and rear extension 125. The corner connection portion 135 may protect the exposed end of the front and rear extension 125 by being contacted, connecting, or coupled to the front-rear extension 125.

FIG. 13 is a cross-sectional view taken along line B-B' of FIG. 11. Referring to FIG. 13, the front frame 130 may be provided with a shield 131 covering the front ends of the vacuum adiabatic module and the edge adiabatic frame to protect an adiabatic shield and internal components. An inner guide 132 that extends further from the inner end of the shield 131 to the inner space of the refrigerator body may be provided.

The inner guide 132 may further extend backward along the inner surface of the vacuum adiabatic module. The inner guide 132 is coupled to the vacuum adiabatic module, and the front panel may be fixed.

FIG. 14 is a view illustrating a connection relationship between the edge adiabatic frame and the front panel.

Referring to FIG. 14, the inner guide 132 of the corner connection portion 135 may be provided in the same manner as the shear shape of the edge adiabatic frame 120. Accordingly, the core connection portion 135 may be provided in the same shape as the adiabatic expansion 123 and the adiabatic contraction 124. Thus, the front frame 130 and the edge adiabatic frame 120 increase in sense of unity. In addition, it is possible to handle articles without interfering with the stepped portion when withdrawing and removing the articles from/into the inner space of the refrigerator body.

Hereinafter, the vacuum adiabatic module according to the embodiment will be described in more detail. The vacuum adiabatic module according to an embodiment may be applied to each of the vacuum adiabatic modules 101, 102, 103, 104, and 105 provided on the wall surface of the refrigerator according to the embodiment.

FIG. 15 is a cross-sectional view of the vacuum adiabatic module according to an embodiment, and FIG. 16 is an exploded perspective view of the vacuum adiabatic module according to an embodiment.

Referring to FIGS. 15 and 16, the vacuum adiabatic module 200 according to an embodiment may include a first plate 210 defining at least a portion of the inner space of the refrigerator body, a second plate 220 defining at least a portion of an outer space, and a support 230 that maintains the vacuum space.

The first plate 210 and the second plate 220 may be directly coupled to each other. Here, the direct coupling of the plates 210 and 220 may mean that a pair of plates 210 and 220 facing each other by a method such as welding are coupled to each other. As the coupling method, for maintaining the vacuum, for example, the two plates 210 and 220 may be directly welded to each other by the welding portion 223.

The first plate 210 may be a portion having a thickness several times less than that of the second plate 220. The first plate may be a portion having a thickness five times less than that of the second plate. The first plate may be made of a stainless steel material having a thickness of about 0.1 mm. The second plate may be made of a stainless steel material having a thickness of about 0.5 mm.

Since the first plate 210 has a small thickness, an amount of thermal conduction through the first plate may be less. The second plate 220 is provided to a thick thickness to prevent its own deformation of the vacuum adiabatic module from occurring by using the large stiffness of the portion itself.

The first plate 210 may include an inner flat plate 211 that defines at least a portion of the inner space of the refrigerator body. The first plate 210 may further include a first bent extension 212 that is bent from an edge of the inner flat plate 211 toward the second plate 220. The first bent extension 212 may provide a thickness portion of the adiabatic space defining the vacuum space. A second bent extension 213 that is bent from the end of the first bent extension 212 in a direction different from the extending direction of the first bent extension 212 is further provided in the first plate 210. The second bent extension 213 may extend along the extending direction of the second plate 220. The first bent extension 212 and the second bent extension 213 may reinforce insufficient strength of the thin first plate 210. The bent extensions 212 and 213 increase in moment of inertia of the first plate 210 to strongly resist to bending force applied to the first plate.

The second bent extension 212 may be coupled to the second plate 220 to provide the vacuum space. The second bent extension 212 and the second plate 220 may be welded to provide a welding portion 223.

The second plate 220 may include an outer flat plate 221 defining at least a portion of the outer space of the refrigerator body. The second plate 220 may further include an edge bent extension 222 that is bent from an edge of the outer flat plate 221 toward the first plate 210. The edge bent extension 222 increases in moment of inertia of the second plate 220 to more strongly resist to bending force applied to the second plate.

A peripheral portion coupled to the second plate 220 may be coupled to the edge bent extension 222. Here, the peripheral portion may include the other adjacent vacuum adiabatic module. The peripheral component may be coupled together or independently to the outer flat plate 221 adjacent to the edge bent extension 222.

FIG. 17 is a schematic view illustrating a process of fabricating the plate.

Referring to FIG. 17, the plates 210 and 220 may be provided by bending a flat plate having a predetermined two-dimensional shape by external force.

For example, in the case of the second plate 220, wings that will provide the edge bent extension 222 may be further provided at four edges of a rectangular two-dimensional plate constituting the outer flat plate 221.

The edge bent extension 222 may be bent from the outer flat plate 221 by a press device. When the edge bent extension 222 is bent, bonding portions 2221 and 2222 of both short ends of the edge bent extension 222 may contact each other. The bonding portions 2221 and 2222 may be sealed to each other by the method such as the welding.

In the case of the first plate 210, like the second plate 220, wings that provide the bent extensions 212 and 213 at four edges of the inner flat plate 211 may be further provided. Thereafter, after the wings are bent twice, the adjacent bonding portions may be sealed to each other by the method such as the welding.

After each of the plates 210 and 220 is fabricated, the second bent extension 213 and the outer flat plate 221 may be sealed to each other to provide a seal. As the seal, a welding portion 223 to which a corresponding portion is welded may be provided.

The welding portion 223 may be performed by laser welding. The welding portion 223 may be provided quickly by traveling around the corresponding portions once in a state in which the second bent extension 213 and the outer flat plate part 221 are in contact with each other.

For example, it is welded more easily when compared to the case of performing two procedures using the separate conductive resistance sheet interposed between the plates. Since a single seal is sufficient by one welding operation, it may be more preferable because the vacuum destruction due to the welding failure may be reduced in half.

The plates 210 and 220 may be provided with bent extensions 212, 213, and 222 by a deep drawing method in addition to the sealing method of the bonding portion. However, it may occur in the bending portion that is forcibly bent at a vertex portion of the portion during the deep drawing process. The bending portion may cause defective contact between the welding portions in the welding process for providing the welding portion 223. The defective contact between the portions may cause welding failure and vacuum destruction. To prevent this phenomenon, careful control of the welding process may be required during the laser welding.

Referring again to FIG. 15, the first bent extension 212 extends toward the outer space of the refrigerator, and the second bent extension 213 extends toward the edge bent extension 222. Thus, the vacuum space having a predetermined thickness and width as the vacuum supported by the support 230 may be provided.

In a state in which the support 230 is accommodated, when the plates 210 and 220 are aligned, surfaces of the second bent extension 213 and the outer flat plate 221 may contact each other. The contact surfaces of the second bent extension 213 and the outer flat plate 221 are welded to each other to provide the welding portion 223, and the vacuum space may be sealed. Thereafter, an exhaust process and a gettering process may be additionally performed.

A peripheral component may be coupled between the welding portion 223 and the edge bent extension 222. Here, the peripheral portion may include adjacent vacuum adiabatic modules.

The edge bent extension 222 may extend toward the inner space of the refrigerator body. The edge bent extension 222 may function as a portion to which the adjacent peripheral components are coupled to each other as well as to reinforces strength of the second plate 220.

Hereinafter, a specific method of fabricating the refrigerator using the vacuum adiabatic module will be described.

FIGS. 18 to 20 are views illustrating a coupling process of the vacuum adiabatic module according to an embodiment, wherein FIG. 18 is a view illustrating an overall process of coupling the vacuum adiabatic modules to each other, FIG. 19 is a cross-sectional view illustrating a process of the adjacent coupling vacuum adiabatic modules to each other, and FIG. 20 is an enlarged view of a main portion of FIG. 19.

Referring to FIG. 18, in this embodiment, the vacuum adiabatic modules are coupled to each other by using the main frame 240 to maintain and increase in strength of the main body of the refrigerator. In the cross section of the main frame 240, two planar portions having different extension directions may be integrated to increase in strength. To increase in structural strength of the refrigerator, the body frame 240 may have a thickness greater than that of each of the plates 210 and 220. For example, a stainless steel material having a thickness of about 1.2 mm may be used.

Specifically, the top surface vacuum adiabatic module 102 and the bottom surface vacuum adiabatic module 103 are coupled to the body frame 240. Next, the rear surface vacuum adiabatic module 104 may be coupled, and then the side surface vacuum adiabatic modules 101 and 105 may be coupled. Lastly, the pedestal 140 may be coupled to a lower end of the refrigerator body.

Referring to FIGS. 19 and 20, the rear surface vacuum adiabatic module 104 and the side surface vacuum adiabatic module 101 are coupled to each other. As described above, after the rear surface vacuum adiabatic module 104 is seated on the main frame 240, the side surface vacuum adiabatic module 101 may be seated.

The rear surface vacuum adiabatic module 104 and the side surface vacuum adiabatic module 101 may be applied to the vacuum adiabatic module according to the forgoing embodiment.

The rear surface vacuum adiabatic module 104 may include a rear support 4230 and a plate. The second plate may include a rear outer flat plate 4221 and a rear edge bent extension 4222. The first plate may include a rear surface inner flat plate 4211, a rear surface first bent extension 4212, and a rear surface second bent extension 4213.

The side surface vacuum adiabatic module 101 may include a side support 1230 and a plate. The second plate may include a side surface outer flat portion 1221 and a side surface edge bent extension 1222. The first plate may include a side surface inner flat plate 1211, a side surface first bent extension 1212, and a side surface second bent extension 1213.

The coupling portion 301 may be coupled at a portion at which the thick second plate and the body frame are aligned. Specifically, at least a portion of the rear surface edge bent extension 4222, the side surface outer plate 1221, and the body frame 240 may be aligned, and the coupling portion 301 may be inserted at the aligned position to couple the portions to each other.

To prevent the coupling portion 301 from being exposed to the outside, a side surface recess 303 may be processed in the side surface outer flat portion 1221, and a rear surface recess 302 may be processed in the rear surface edge bent extension 4222. A rivet may be used as the coupling portion, and a head of the rivet may be inserted into the inner space of the recesses 302 and 303. For this, the recess may be recessed toward the inside of the refrigerator. A hole into which the head of the rivet is inserted may be processed in the body frame 240.

A thick portion 310 may be provided at an end of the side surface edge bent extension 1222. According to the thick portion 310, the strength may increase. The thick portion 310 may be provided by folding an end of the side surface edge bent extension 1222.

A rear surface protrusion 311 may be provided at a position aligned with an inner end of the thick portion 310. When the side surface vacuum adiabatic module 101 is inserted into the rear surface vacuum adiabatic module 104, the thick portion 310 may pass over the rear surface protrusion 311.

The position at which the thick portion 310 passes over the rear surface protrusion 311, that is, the position at which the inner end of the thick portion 310 meets the outer end of the rear surface protrusion 311, may be provided as a position at which the side surface vacuum adiabatic module 101 and the rear surface vacuum adiabatic module 104 are completely aligned before being coupled to each other. According to this configuration, even before the vacuum adiabatic module is completely coupled using the coupling portion 301, the vacuum adiabatic modules may be temporarily assembled to each other to determine the coupling position. A worker may conveniently find out the bonding position between the vacuum adiabatic modules.

The welding portion 4223 may be closer to the vacuum space than the rear surface protrusion 311, and thus, there is no fear of the vacuum destruction. Although not shown, the welding portion provided on the side surface vacuum adiabatic module may be closer to the vacuum space than the coupling portions 301 and the recesses 301 and 302, and thus, there is no fear of the vacuum destruction. In other words, it is desirable that an impact applied to the welding portion due to an interference between components during the processing or during the coupling is removed as much as possible.

The coupling between the vacuum adiabatic modules described in FIGS. 19 and 20 and the coupling between the vacuum adiabatic module and the body frame may be applied to the coupling of other vacuum adiabatic modules as well. For example, when the top surface vacuum adiabatic module is coupled to the body frame, the top surface recess may be performed by a process in which the coupling portion is inserted while the body frame is aligned.

The first plate of the vacuum adiabatic module may define at least a portion of the low-temperature inner space of the refrigerator body. For this reason, the side surface inner flat plate 1211, the side surface first bent extension 1212, the side surface second bent extension 1213, the rear surface inner flat plate 4211, the rear surface first bent extension 4212, the rear surface second bent extension 4213, and other adjacent portions in contact therewith may conduct the cool air in the low-temperature space to the outside. An adiabatic material may be used to resist to the conduction heat that is conducted by the first plate. Since the first plate is thinner than the second plate, it may exhibit relatively low thermal conductivity. For this reason, it is seen that the first plate serves as the conductive resistance sheet.

The adiabatic material may include an insertion adiabatic material 129 provided in the outer space of the refrigerator body, and an edge adiabatic frame 120 provided in the inner space of the refrigerator body.

The lightweight polyurethane having the plurality of pores may be used to perform the adiabatic function and the strength reinforcement function together with the insertion adiabatic material and the edge adiabatic frame.

The insertion adiabatic material 129 may be fixed at a position coupled to the body frame 240 or may be coupled by the coupling portion 301.

The insertion adiabatic material 129 may be inserted into a region defined as inner space of the edge portion of the side surface inner flat plate 1211, the side surface first bent extension 1212, the side surface second bent extension 1213, the edge portion of the rear surface inner flat plate 4211, the rear surface first bent extension 4212, the rear surface second bent extension 4213, the side surface edge bent extension 1222, and the rear surface edge bent extension 4222. The cool air discharged to the outside of the refrigerator body by passing over the first plate may be reduced by the insertion adiabatic material 129.

The edge adiabatic frame 120 may prevent the low-temperature atmosphere of the inner space of the refrigerator main body from directly contacting the edge of the side surface inner flat plate 1221 and the edge of the rear surface inner side flat plate 4211.

Accordingly, it is possible to reduce an amount of heat transferred as much as possible from the outside to the inside of the refrigerator by passing over the first plate. In other words, thermal conduction transferred to the inside of the refrigerator along the thin first plate may increase in length to reduce heat transferred to the inside of the refrigerator. Since the first plate is provided to be thinner than the second plate, the effect of reducing the thermal conductivity may relatively increase.

The configuration of the edge adiabatic frame 120 may be applied as described above through FIG. 12 or the like.

Hereinafter, another specific embodiment of the method for fabricating the refrigerator using the vacuum adiabatic module will be described.

FIGS. 21 to 24 are views illustrating a coupling process of a vacuum adiabatic module according to another embodiment, wherein FIG. 21 is a view illustrating an overall process of coupling vacuum adiabatic modules to each other, FIG. 22 is a cross-sectional view illustrating a process of adjacent coupling vacuum adiabatic modules to each other, FIG. 23 is a cross-sectional view illustrating a process of adjacent coupling vacuum adiabatic modules to each other, and FIG. 24 is an enlarged view of a coupled main portion.

The coupling of the vacuum adiabatic module according to another embodiments is different from the coupling of the vacuum adiabatic module in that the main frame 240 is not provided, unlike the configuration illustrated in FIGS. 18 to 20. Therefore, except for the description related to the main frame 240, the description of FIGS. 18 to 20 may be applied to the coupling of the vacuum adiabatic module according to another embodiment.

Referring to FIGS. 21 and 22, the vacuum adiabatic module providing each wall of the refrigerator may be directly coupled to another vacuum adiabatic module adjacent to the edge of the vacuum adiabatic module.

In this embodiment, the rear surface vacuum adiabatic module 104 may be temporarily assembled by being fitted into the side surface vacuum adiabatic modules 101 and 105. The top surface vacuum adiabatic module 102 and the rear surface vacuum adiabatic module 103 may be fitted into the side surface vacuum adiabatic modules 101 and 105 in a similar manner so as to be temporarily assembled.

The temporary assembly may be performed by an insertion pocket 330 and a coupling protrusion 334. Specifically, the coupling protrusion 334 may be inserted into the insertion pocket 330 and then be fixed in position so as to perform the temporary assembly.

After the temporary assembly, the coupling between the vacuum adiabatic modules may be completed by the side surface edge bent extension 1222 and the rear surface outer flat plate 4221, which are coupled by the coupling portion 336. Here, various methods such as a welding portion, a rivet, and a screw may be applied as the coupling portion. Here, the coupling positions of the side surface edge bent extension 1222 and the rear surface outer flat plate 4221 may correspond to the rear surface of the refrigerator. Similarly, the side surface edge bent extension 1222 and the top surface vacuum adiabatic module may be coupled on the top surface of the refrigerator, and the side surface edge bent extension 1222 and the bottom surface vacuum adiabatic module may be coupled on the bottom surface of the refrigerator.

The coupling portion that exemplifies the welding portion may not be provided on the outer flat plate of the side surface vacuum adiabatic modules 101 and 105. Accordingly, the side surface of the refrigerator may provide a clean flat structure, and an increase in thickness due to the additional use of a decorative panel may be suppressed to secure a wider installation space of the refrigerator.

The configuration and operation for the temporary assembly will be described in more detail.

An insertion pocket 330 provided by bending the second plate may be provided at a connection portion at which the side surface outer flat portion 1221 and the side edge bent extension 1222 are connected to each other. The insertion pocket 330 may have a narrow opening at a rear side and a wide inner space. To provide the connection portion, an end of the side surface outer flat plate 1221 may be provided with a thick portion 332 by bending the second plate. The side surface vacuum adiabatic modules 101 and 105 may increase in strength by the thick portion.

The rear surface edge bent extension 4222 may be inserted into the insertion pocket 330. A coupling protrusion 334 may be provided to the rear surface edge bent extension 4222 to prevent the rear surface edge bent extension 4222 from being easily separated by an external impact after being inserted. The coupling protrusion 334 may be provided as an uneven portion provided on the rear edge bent extension 4222. The coupling protrusion 334 may be inserted by expanding the narrow opening of the insertion pocket 330. After the coupling protrusion 334 is completely inserted into the inside of the insertion pocket 330, an inlet of the insertion pocket 330 may return to its original shape. The coupling protrusion 334 is hooked inside the insertion pocket 330 so that the rear surface edge bent extension 4222 is fixed at a set position without being separated from the inside of the insertion pocket 330.

In the case of this embodiment, an insertion adiabatic material 129 may be provided in a state of being coupled to the side surface vacuum adiabatic module 101. The edge adiabatic frame 120 may be coupled to the side surface inner flat plate 1211 and the rear surface inner flat plate 4211 by a method such as adhesion.

The functions of the insertion adiabatic material and the edge adiabatic frame may be applied as described above.

According to this embodiment, without providing a separate body frame, the vacuum adiabatic modules may be coupled to each other.

The vacuum adiabatic module 200 may be provided in various shapes corresponding to the size of each wall surface defining the refrigerator. However, since the vacuum adiabatic module fabricated in a predetermined size may be applied to a side of each wall of the refrigerator as a standardized component, a stock management of the components may be convenient, and the components may be communized to reduce fabricating costs of the product.

Hereinafter, the configuration and operation of the refrigeration system of the refrigerator according to the embodiment will be described.

FIG. 25 is a view for explaining mounting of components of the refrigeration system of the refrigerator according to an embodiment, and FIGS. 26 and 27 are views for explaining front and rear sides of a passage guide guiding the cool air to the space within the refrigerator.

Referring to FIGS. 25 to 27, a compressor 4, a condenser 5, and the like may be accommodated in the pedestal 140. The components of the refrigeration system such as the compressor may be accommodated in the machine room drawer 141 and may be withdrawn or inserted if necessary.

A refrigerant condensed and expanded in the pedestal 140 is guided to the evaporator 7 provided inside the freezing compartment (F compartment) through a refrigerant pipe 9. The refrigerant may be evaporated in the evaporator 7 to supply cool air to the inside of the freezing compartment.

The cool air inside the freezing compartment may be evenly supplied to the inner space of the freezing compartment by a freezing compartment passage guide 301.

A portion of the cool air of the evaporator 7 may pass through a mullion 300 and be guided to a refrigerating compartment passage guide 302. Here, the mullion 300 may be provided as a separate article that partitions the inner space of the refrigerator. The refrigerating compartment passage guide 302 may uniformly supply the cool air to the inner space of the refrigerating compartment (R compartment). The cool air that completely performs a cooling operation in the refrigerating compartment may be reintroduced into the evaporator 7 through the mullion.

INDUSTRIAL APPLICABILITY

The present invention proposes the vacuum adiabatic module that is capable of being applied as the module in the case of various adiabatic products provided in various sizes, structures, and shapes.

Since the vacuum adiabatic module in which the vacuum adiabatic body is modularized may be provided to drastically reduce the amount of adiabatic products, particularly components used in refrigerator. The refrigerator may be more conveniently fabricated using the vacuum adiabatic module.

Due to such the proposed plan, it may be possible to expect the effect that further approaches the industrial use of the vacuum adiabatic body.

The invention claimed is:

1. A vacuum adiabatic body comprising:

a first plate configured to define at least a portion of a wall for a first space;

a second plate comprising an outer flat portion configured to define at least a portion of a wall for a second space;

a seal configured to seal between the first plate and the second plate so as to provide a third space, and the third space to be in a vacuum state; and a support configured to maintain the third space;

wherein the first plate comprises:

an inner flat portion configured to define at least a portion of the wall for the first space;

a first extension portion to extend in a first direction from an edge of the inner flat portion toward the second space, the first extension portion providing a thickness portion of the third space; and a second extension portion to extend from an edge of the first extension portion in a second direction transverse to the first direction, wherein the second extension portion contacts the outer flat portion of the second plate, and the seal is provided on a contact surface between the second extension portion and the outer flat portion, wherein the second plate further comprises an edge extension portion that extends from an edge of the outer flat portion in a third direction opposite to the first direction, the seal being disposed between the edge extension portion and the first extension portion, and wherein a length of the edge extension portion of the second plate in the third direction is less than a length of the first extension portion of the first plate in the first direction.

2. The vacuum adiabatic body according to claim 1, wherein a thickness of the first plate is less than a thickness of the second plate.

3. The vacuum adiabatic body according to claim 1, wherein the seal is a plurality of welds at corresponding portions of the second extension portion and the outer flat portion.

4. The vacuum adiabatic body according to claim 3, wherein the welds are singly connected to each other.

5. A refrigerator comprising:

a main body defining an accommodation space and having an opening to the accommodation space; and a door configured to open and close the opening of the accommodation space, wherein the main body includes:

first and second vacuum adiabatic modules coupled to each other; and an adiabatic material to be provided at an area at which the first vacuum adiabatic module is coupled to the second vacuum adiabatic module, wherein each of the first and second vacuum adiabatic modules separately comprises:

a first plate configured to define at least a portion of a wall for the accommodation space;

a second plate configured to define at least a portion of a wall for an outer space from the accommodation space;

a seal configured to seal between the first plate and the second plate to provide a vacuum space, and the vacuum space to be in a vacuum state; and a support configured to maintain the vacuum space, wherein the first plate comprises:

an inner flat portion having at least a flat portion;

a first extension portion that extends from the inner flat portion in a first direction toward the outer space; and a second extension portion that extends from the first extension portion in a second direction transverse to the first direction, wherein the second plate comprises:

an outer flat portion having at least a flat portion; and an edge extension portion that extends from the outer flat portion toward the accommodation space, wherein the adiabatic material comprises:

an insertion adiabatic material to be provided in the outer space; and an edge adiabatic frame provided at the accommodation space to reduce thermal conduction through the first plate, wherein the refrigerator comprises a thick portion provided by a folded end of the edge extension portion of the second vacuum adiabatic module and a protrusion provided on the outer flat portion of the first vacuum adiabatic module, and wherein the thick portion of the second vacuum adiabatic module passes over the protrusion of the first vacuum adiabatic module.

6. The refrigerator according to claim 5, comprising a pedestal to be provided below the main body.

7. The refrigerator according to claim 6, wherein a machine room drawer is provided at the pedestal to accommodate components of a refrigeration system-1.

8. The refrigerator according to claim 5, comprising a front frame configured to cover a front end of the edge adiabatic frame.

9. The refrigerator according to claim 5, wherein the edge adiabatic frame is configured to cover a connection portion to which the first vacuum adiabatic module is coupled.

10. The refrigerator according to claim 5, comprising:

a first recess at the outer flat portion of the second vacuum adiabatic module;

a second recess provided in the edge extension portion of the first vacuum adiabatic module, which corresponds to the first recess; and a main body frame in which a hole is to receive a coupling portion, the main body frame being configured to provide a frame of the main body.

11. The refrigerator according to claim 5, wherein the first vacuum adiabatic module is a rear surface vacuum adiabatic module configured to provide a rear surface of the main body, and the second vacuum adiabatic module is a side surface vacuum adiabatic module configured to provide a side surface of the main body.

12. The refrigerator according to claim 5, comprising:

an insertion pocket having a narrow inlet, the insertion pocket being provided on a connection portion between the outer flat portion of the second vacuum adiabatic module and the edge extension portion of the first vacuum adiabatic module; and the first vacuum adiabatic module comprising the edge extension portion, the first vacuum adiabatic module having a coupling protrusion to be inserted into the insertion pocket.

13. The refrigerator according to claim 12, wherein the edge extension portion of the first vacuum adiabatic module is coupled to the outer flat portion of the second vacuum adiabatic module.

14. A refrigerator comprising:

a main body to define an accommodation space and having an opening to the accommodation space; and a door configured to open and close the opening of the accommodation space, wherein the main body comprises the vacuum adiabatic body of claim 1.

15. A refrigerator comprising:

a main body to define an accommodation space and having an opening to the accommodation space; and a door configured to open and close the opening of the accommodation space, wherein the main body comprises:

first and second vacuum adiabatic modules coupled to each other; and an adiabatic material to be provided at an area at which the first vacuum adiabatic module is coupled to the second vacuum adiabatic module, wherein each of the first and second vacuum adiabatic modules comprises:

a first plate configured to define at least a portion of a first wall for the accommodation space;

a second plate configured to define at least a portion of a second wall for an outer space from the accommodation space, wherein the first plate is thinner than the second plate; and a seal configured to seal the first plate and the second plate to provide a vacuum space, and the vacuum space is to be provided into a vacuum state, wherein the first plate comprises:

an inner flat portion;

a first extension portion that extends from the inner flat portion in a direction toward the outer space; and a second extension portion that extends from the first extension portion in a second direction transverse to the first direction, wherein the second plate comprises an outer flat portion and an edge extension portion that extends from the outer flat portion toward the accommodation space, wherein the adiabatic material comprises:

an insertion adiabatic material provided in the outer space, the insertion adiabatic material being inserted into a region defined as the inner flat portion, the first and second extension portions and the edge extension portion of the first vacuum adiabatic module, and the inner flat portion, the first and second extension portions and the edge extension portion of the second vacuum adiabatic module; and an edge adiabatic frame provided in the accommodation space and including extensions to block an inner edge of the main body to reduce thermal conduction through the first plate.

16. A refrigerator comprising:

a main body defining an accommodation space and having an opening to the accommodation space; and a door configured to open and close the opening of the accommodation space, wherein the main body includes:

first and second vacuum adiabatic modules coupled to each other; and an adiabatic material to be provided at an area at which the first vacuum adiabatic module is coupled to the second vacuum adiabatic module, wherein each of the first and second vacuum adiabatic modules separately comprises:

a first plate configured to define at least a portion of a wall for the accommodation space;

a second plate configured to define at least a portion of a wall for an outer space from the accommodation space;

a seal configured to seal between the first plate and the second plate to provide a vacuum space, and the vacuum space to be in a vacuum state; and a support configured to maintain the vacuum space, wherein the first plate comprises:

an inner flat portion having at least a flat portion;

a first extension portion that extends from the inner flat portion in a first direction toward the outer space; and a second extension portion that extends from the first extension portion in a second direction transverse to the first direction, wherein the second plate comprises:

an outer flat portion having at least a flat portion; and an edge extension portion that extends from the outer flat portion toward the accommodation space, wherein the adiabatic material comprises:

an insertion adiabatic material to be provided in the outer space; and an edge adiabatic frame provided at the accommodation space to reduce thermal conduction through the first plate, wherein the refrigerator comprises:

a first recess at the outer flat portion of the second vacuum adiabatic module;

a second recess provided in the edge extension portion of the first vacuum adiabatic module, which corresponds to the first recess; and a main body frame in which a hole is to receive a coupling portion, the main body frame being configured to provide a frame of the main body.

17. A refrigerator comprising:

a main body defining an accommodation space and having an opening to the accommodation space; and a door configured to open and close the opening of the accommodation space, wherein the main body includes:

first and second vacuum adiabatic modules coupled to each other; and an adiabatic material to be provided at an area at which the first vacuum adiabatic module is coupled to the second vacuum adiabatic module, wherein each of the first and second vacuum adiabatic modules separately comprises:

a first plate configured to define at least a portion of a wall for the accommodation space;

a second plate configured to define at least a portion of a wall for an outer space from the accommodation space;

a seal configured to seal between the first plate and the second plate to provide a vacuum space, and the vacuum space to be in a vacuum state; and a support configured to maintain the vacuum space, wherein the first plate comprises:

an inner flat portion having at least a flat portion;

a first extension portion that extends from the inner flat portion in a first direction toward the outer space; and a second extension portion that extends from the first extension portion in a second direction transverse to the first direction, wherein the second plate comprises:

an outer flat portion having at least a flat portion; and an edge extension portion that extends from the outer flat portion toward the accommodation space, wherein the adiabatic material comprises:

an insertion adiabatic material to be provided in the outer space; and an edge adiabatic frame provided at the accommodation space to reduce thermal conduction through the first plate, wherein the refrigerator comprises:

an insertion pocket having a narrow inlet, the insertion pocket being provided on a connection portion between the outer flat portion of the second vacuum adiabatic module and the edge extension portion of the first vacuum adiabatic module, and a coupling protrusion provided in the first adiabatic module and inserted into the insertion pocket.

* * * * *